US012286769B2

(12) United States Patent
Shiratani et al.

(10) Patent No.: US 12,286,769 B2
(45) Date of Patent: Apr. 29, 2025

(54) WORK MACHINE AND ASSIST DEVICE TO ASSIST IN WORK WITH WORK MACHINE

(71) Applicant: SUMITOMO CONSTRUCTION MACHINERY CO., LTD., Tokyo (JP)

(72) Inventors: Ryuji Shiratani, Chiba (JP); Daisuke Kitajima, Chiba (JP); Hajime Aragaki, Chiba (JP)

(73) Assignee: SUMITOMO CONSTRUCTION MACHINERY CO., LTD., Tokyo (JP)

( * ) Notice: Subject to any disclaimer, the term of this patent is extended or adjusted under 35 U.S.C. 154(b) by 383 days.

(21) Appl. No.: 17/647,892

(22) Filed: Jan. 13, 2022

(65) Prior Publication Data

US 2022/0136215 A1 May 5, 2022

Related U.S. Application Data

(63) Continuation of application No. PCT/JP2020/027974, filed on Jul. 17, 2020.

(30) Foreign Application Priority Data

Jul. 17, 2019 (JP) ..... 2019-132194

(51) Int. Cl.
*E02F 9/26* (2006.01)

(52) U.S. Cl.
CPC ..... *E02F 9/261* (2013.01)

(58) Field of Classification Search
CPC ..... E02F 9/261; E02F 3/435; E02F 3/962; E02F 9/2033; E02F 3/32; E02F 3/43; B66C 13/46
See application file for complete search history.

(56) References Cited

U.S. PATENT DOCUMENTS 4,174,579 A * 11/1979 Learmont ..... E02F 3/48 37/395
5,960,378 A * 9/1999 Watanabe ..... E02F 3/32 37/415
6,079,131 A * 6/2000 Oshina ..... E02F 9/265 37/348

(Continued)

FOREIGN PATENT DOCUMENTS

EP 4296434 A1 * 12/2023 ..... E02F 3/325
JP 4012448 B2 * 11/2007 ..... E02F 9/2045

(Continued)

OTHER PUBLICATIONS

"Practical Full Automation of Excavation and Loading for Hydraulic Excavators in Indoor Environments;" Yoshida et al., 2021 IEEE 17th International Conference on Automation Science and Engineering (CASE) (pp. 2153-2160); Aug. 23, 2021. (Year: 2021).*

(Continued)

*Primary Examiner* — Khoi H Tran
*Assistant Examiner* — Jorge O Peche
(74) *Attorney, Agent, or Firm* — IPUSA, PLLC

(57) ABSTRACT

A work machine includes a lower traveling structure, an upper swing structure swingably mounted on the lower traveling structure, an attachment attached to the upper swing structure, a surrounding area monitor, and a display. The display is configured to display guidance with respect to an object detected by the surrounding area monitor.

21 Claims, 18 Drawing Sheets

(56) References Cited

U.S. PATENT DOCUMENTS 7,532,967 B2 * 5/2009 Fujishima ..... E02F 9/265 701/50
9,616,748 B2 4/2017 Tsubone et al.
10,344,450 B2 * 7/2019 Sharp ..... E02F 9/24
10,508,416 B2 * 12/2019 Yamaguchi ..... G01C 11/06
11,697,920 B2 * 7/2023 Kiyota ..... E02F 9/26 382/103
2003/0036817 A1 * 2/2003 Morley ..... E02F 9/205 700/245
2005/0027420 A1 * 2/2005 Fujishima ..... E02F 9/2045 701/50
2006/0042397 A1 * 3/2006 Kurita ..... G01V 5/20 73/800
2010/0289899 A1 * 11/2010 Hendron ..... B60R 9/055 348/148
2012/0290178 A1 * 11/2012 Suzuki ..... E02F 9/265 701/50
2013/0158788 A1 * 6/2013 Seki ..... E02F 9/261 701/34.4
2013/0166143 A1 * 6/2013 Seki ..... G01S 19/47 701/34.4
2014/0188333 A1 7/2014 Friend
2014/0267731 A1 * 9/2014 Izumikawa ..... B60R 1/00 348/148
2015/0183370 A1 * 7/2015 Nakanishi ..... G08G 1/166 348/148
2015/0218781 A1 8/2015 Nomura et al.
2016/0010312 A1 * 1/2016 Kurihara ..... E02F 9/261 701/36
2016/0076228 A1 * 3/2016 Nau ..... E02F 3/842 701/50
2016/0153171 A1 * 6/2016 Shimizu ..... B60R 3/005 180/89.1
2016/0193920 A1 * 7/2016 Tsubone ..... B60K 35/00 701/36
2016/0237654 A1 * 8/2016 Arimatsu ..... E02F 9/26
2016/0251834 A1 * 9/2016 Arimatsu ..... E02F 9/26 414/687
2016/0251835 A1 * 9/2016 Kitajima ..... E02F 3/3663 701/50
2016/0298316 A1 * 10/2016 Iwamura ..... E02F 3/435
2016/0369475 A1 * 12/2016 Tanaka ..... E02F 3/32
2017/0002547 A1 * 1/2017 Omote ..... E02F 9/264
2017/0017238 A1 * 1/2017 Tojima ..... G01S 13/876
2017/0073934 A1 * 3/2017 Kiyota ..... E02F 9/24
2017/0083760 A1 * 3/2017 Kiyota ..... H04N 7/18
2017/0089041 A1 * 3/2017 Kawamoto ..... E02F 9/265
2017/0107693 A1 * 4/2017 Yamada ..... E02F 9/26
2017/0114526 A1 * 4/2017 Yasuda ..... E02F 9/264
2017/0122741 A1 * 5/2017 Sakai ..... G05D 1/0274
2017/0260717 A1 * 9/2017 Seki ..... E02F 3/32
2018/0038165 A1 * 2/2018 Park ..... E21B 7/028
2018/0074201 A1 * 3/2018 Sakai ..... G05D 1/0274
2018/0080198 A1 * 3/2018 Machida ..... E02F 9/261
2018/0137446 A1 * 5/2018 Shike ..... G06Q 50/08
2018/0179734 A1 * 6/2018 Yamashita ..... E02F 9/2033
2018/0187393 A1 * 7/2018 Amaya ..... E02F 3/32
2018/0245315 A1 * 8/2018 Kaiso ..... G06T 7/70
2018/0258616 A1 * 9/2018 Kiyota ..... G06T 1/00
2018/0313653 A1 * 11/2018 Sakai ..... G07C 5/008
2018/0371723 A1 * 12/2018 Nishi ..... G05D 1/0094
2018/0373032 A1 * 12/2018 Ohiwa ..... E02F 9/265
2019/0072399 A1 * 3/2019 Sakai ..... G05D 1/0278
2019/0072403 A1 * 3/2019 Sakai ..... G01C 21/30
2019/0127946 A1 * 5/2019 Sakai ..... E02F 9/2203
2019/0218749 A1 * 7/2019 Hiromatsu ..... E02F 3/841
2020/0018037 A1 * 1/2020 Nakamura ..... E02F 3/43
2020/0040548 A1 * 2/2020 Shimizu ..... E02F 9/2012
2020/0071910 A1 * 3/2020 Cosoli ..... B60T 8/1701
2020/0208373 A1 * 7/2020 Nakamura ..... G01G 19/08
2020/0232179 A1 * 7/2020 Sasaki ..... E02F 9/2041
2020/0263395 A1 * 8/2020 Ohiwa ..... E02F 3/435
2020/0277753 A1 * 9/2020 Roh ..... E02F 9/264
2020/0299924 A1 * 9/2020 Kurokawa ..... E02F 9/262
2020/0340208 A1 * 10/2020 Kitajima ..... B66C 23/86
2020/0354920 A1 * 11/2020 Horii ..... E02F 3/435
2020/0393827 A1 * 12/2020 Hayashi ..... G05D 1/0038
2021/0002850 A1 * 1/2021 Wu ..... E02F 9/2285
2021/0047154 A1 * 2/2021 Hayashi ..... G05D 1/223
2021/0087794 A1 * 3/2021 Yamamoto ..... B60R 1/27
2021/0156115 A1 * 5/2021 Kovanen ..... G06V 20/52
2021/0156121 A1 * 5/2021 Hayakawa ..... G01B 11/24
2021/0180291 A1 * 6/2021 Saiki ..... E02F 9/26
2021/0276838 A1 * 9/2021 Minami ..... B66C 13/46
2021/0276839 A1 * 9/2021 Minami ..... B66C 23/06
2021/0292998 A1 * 9/2021 Kawamoto ..... E02F 9/261
2021/0332560 A1 * 10/2021 Takebayashi ..... E02F 9/2296
2021/0404151 A1 * 12/2021 Nakazawa ..... E02F 9/264
2022/0010522 A1 * 1/2022 Shiratani ..... E02F 9/205
2022/0018096 A1 * 1/2022 Nishi ..... G06N 3/045
2022/0026587 A1 * 1/2022 Hayakawa ..... G01C 15/06
2022/0136215 A1 * 5/2022 Shiratani ..... E02F 9/261 701/50
2022/0154742 A1 * 5/2022 Nakano ..... E02F 9/2292
2022/0194757 A1 * 6/2022 Sasaoka ..... B66C 23/905
2022/0205225 A1 * 6/2022 Shiratani ..... E02F 9/2296
2022/0219948 A1 * 7/2022 Hayashi ..... B66C 13/22
2022/0297986 A1 * 9/2022 Satou ..... B66C 23/905
2022/0298747 A1 * 9/2022 Ishida ..... H04B 17/318
2022/0300025 A1 * 9/2022 Katoh ..... G05G 5/02
2022/0316188 A1 * 10/2022 Takahama ..... E02F 3/841
2022/0333357 A1 * 10/2022 Eguchi ..... E02F 9/262
2022/0364323 A1 * 11/2022 Gilbeck ..... E02F 9/262
2022/0364335 A1 * 11/2022 Spendlove ..... E02F 9/2045
2022/0389685 A1 * 12/2022 Kovanen ..... G01C 15/002
2023/0228063 A1 * 7/2023 Kondo ..... E02F 9/2037 60/421
2023/0279634 A1 * 9/2023 Yamamoto ..... E02F 3/435 414/685
2023/0279638 A1 * 9/2023 Danguchi ..... E02F 9/24 701/50
2023/0279645 A1 * 9/2023 Danguchi ..... E02F 9/261
2023/0366171 A1 * 11/2023 Morikawa ..... E02F 3/437
2023/0417548 A1 * 12/2023 Kean ..... E02F 3/325
2024/0018750 A1 * 1/2024 Nishi ..... G06T 11/206
2024/0018751 A1 * 1/2024 Pahl ..... E02F 9/264
2024/0018752 A1 * 1/2024 Fujiwara ..... E02F 9/262
2024/0026651 A1 * 1/2024 Nishi ..... H04N 7/181
2024/0026654 A1 * 1/2024 Satoh ..... E02F 9/26
2024/0052600 A1 * 2/2024 Nishikawa ..... E02F 9/24
2024/0068201 A1 * 2/2024 Ozaki ..... E02F 9/2029
2024/0134064 A1 * 4/2024 Ishihara ..... E02F 9/267
2024/0265573 A1 * 8/2024 Aizawa ..... E02F 9/20
2024/0352702 A1 * 10/2024 Suzuki ..... E02F 3/3681
2024/0352713 A1 * 10/2024 Matsuyama ..... E02F 9/20

FOREIGN PATENT DOCUMENTS

JP 2013-151830 8/2013
JP 2013151830 A * 8/2013
JP 5476450 B1 * 4/2014 ..... E02F 3/435
JP 2014-098270 5/2014
JP 2016-065449 4/2016
JP 2016-089388 5/2016
JP 2017-186901 10/2017
JP 2018-141364 9/2018
JP 6407663 10/2018
KR 20200039613 A * 4/2020
WO WO-2012128199 A1 * 9/2012 ..... E02F 9/261
WO 2017/110381 6/2017
WO WO-2018220914 A1 * 12/2018 ..... B60R 1/00
WO 2019/124549 6/2019
WO WO-2020204007 A1 * 10/2020 ..... E02F 3/435
WO WO-2020204239 A1 * 10/2020 ..... E02F 3/435

OTHER PUBLICATIONS

"Field and service applications—Dragline automation—A dedade of development—Shared Autonomy for Improving Mining Equipment Productivity;" Winstanley et al., IEEE Robotics & Automation Magazine (vol. 14, Issue: 3, pp. 52-64); Sep. 1, 2007. (Year: 2007).*

(56) References Cited

OTHER PUBLICATIONS

"A robotic excavator for autonomous truck loading;" Stentz et al., Proceedings. 1998 IEEE/RSJ International Conference on Intelligent Robots and Systems. Innovations in Theory, Practice and Applications (Cat. No.98CH36190) (vol. 3, pp. 1885-1893 vol.3); Jan. 1, 1998. (Year: 1998).*

International Search Report for PCT/JP2020/027974 mailed on Oct. 6, 2020.

* cited by examiner

WORK MACHINE AND ASSIST DEVICE TO ASSIST IN WORK WITH WORK MACHINE

CROSS-REFERENCE TO RELATED APPLICATIONS

This application is a continuation application filed under 35 U.S.C. 111(a) claiming benefit under 35 U.S.C. 120 and 365(c) of PCT International Application No. PCT/JP2020/027974, filed on Jul. 17, 2020 and designating the U.S., which claims priority to Japanese Patent Application No. 2019-132194, filed on Jul. 17, 2019. The entire contents of the foregoing applications are incorporated herein by reference.

BACKGROUND

Technical Field

The present disclosure relates to work machines and assist devices to assist in work with work machines.

Description of Related Art

A shovel that captures an image of an area that is the blind spot of an operator with a camera attached to an upper swing structure and causes the captured image to be displayed on a display device installed in a cabin has been known.

This shovel is configured to display a guideline serving as a distance indicator line over the image captured with the camera.

SUMMARY

According to an aspect of the present invention, a work machine includes a lower traveling structure, an upper swing structure swingably mounted on the lower traveling structure, an attachment attached to the upper swing structure, a surrounding area monitor, and a display. The display is configured to display guidance with respect to an object detected by the surrounding area monitor.

DETAILED DESCRIPTION

The related-art shovel, which is configured to display a guideline serving as a distance indicator line over the image captured with the camera, is not configured to present information on an area in front of the upper swing structure to the operator.

Thus, it is desirable to make it possible to more effectively assist an operator in operating a work machine such as a shovel by presenting information on an area in front of an upper swing structure to the operator.

According to an embodiment of the present invention, a work machine that can more effectively assist an operator in operating the work machine is provided.

Figure 1A:
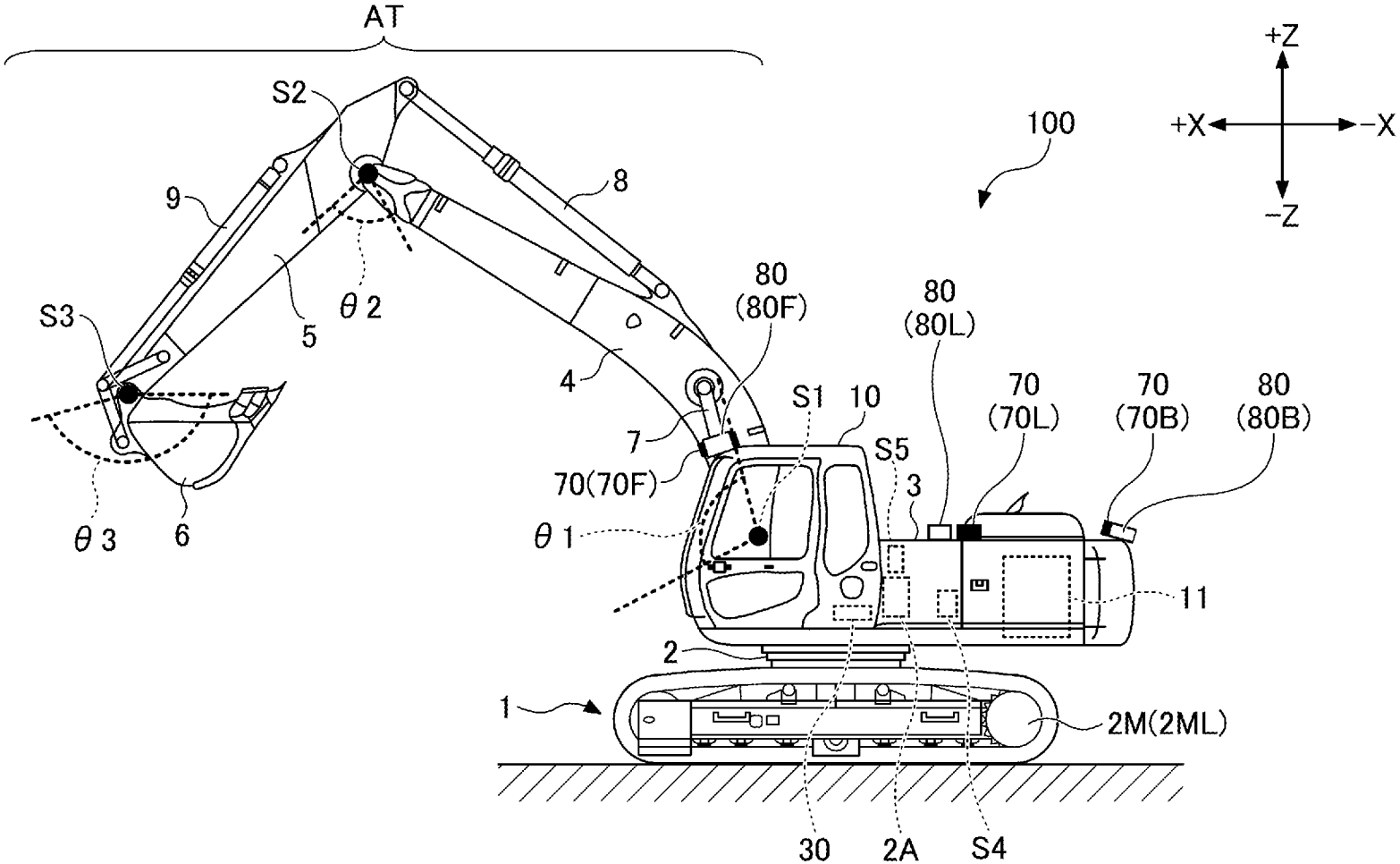
FIG. 1A is a side view of a shovel according to an embodiment of the present invention.
Figure 1B:
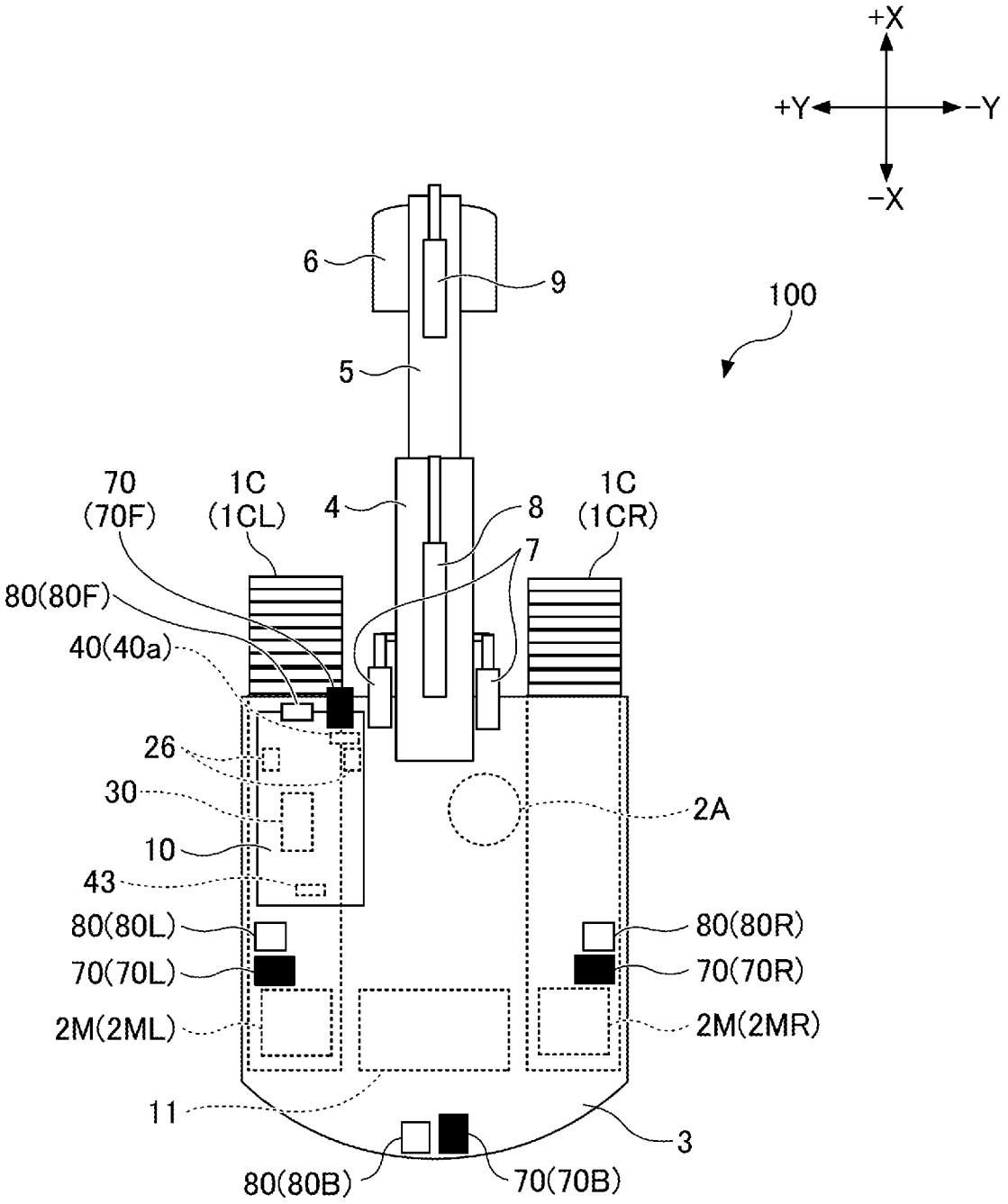
FIG. 1B is a top plan view of the shovel illustrated in FIG. 1A.

First, a shovel 100 serving as an excavator according to an embodiment of the present invention is described with reference to FIGS. 1A and 1B. FIG. 1A is a side view of the shovel 100, and FIG. 1B is a top plan view of the shovel 100.

According to this embodiment, a lower traveling structure 1 of the shovel 100, which is an example of a work machine, includes crawlers 1C. The crawlers 1C are driven by travel hydraulic motors 2M installed in the lower traveling structure 1. Specifically, the crawlers 1C include a left crawler 1CL and a right crawler 1CR. The travel hydraulic motors 2M include a left travel hydraulic motor 2ML and a right travel hydraulic motor 2MR. The left crawler 1CL is driven by the left travel hydraulic motor 2ML and the right crawler 1CR is driven by the right travel hydraulic motor 2MR.

An upper swing structure 3 is swingably mounted on the lower traveling structure 1 via a swing mechanism 2. The swing mechanism 2 is driven by a swing hydraulic motor 2A mounted on the upper swing structure 3. The swing mechanism 2, however, may also be driven by a swing motor generator.

A boom 4 is attached to the upper swing structure 3. An arm 5 is attached to the distal end of the boom 4. A bucket 6 serving as an end attachment is attached to the distal end of the arm 5. The boom 4, the arm 5, and the bucket 6 constitute an excavation attachment AT, which is an example of an attachment. The boom 4 is driven by a boom cylinder 7. The arm 5 is driven by an arm cylinder 8. The bucket 6 is driven by a bucket cylinder 9.

The boom 4 is pivotably supported by the upper swing structure 3. A boom angle sensor S1 is attached to the boom 4. The boom angle sensor S1 can detect a boom angle θ1, which is the pivot angle of the boom 4. The boom angle θ1 is, for example, a rise angle from the most lowered position of the boom 4. Therefore, the boom angle θ1 is maximized when the boom 4 is most raised.

The arm 5 is pivotably supported by the boom 4. An arm angle sensor S2 is attached to the arm 5. The arm angle sensor S2 can detect an arm angle θ2, which is the pivot angle of the arm 5. The arm angle θ2 is, for example, an opening angle from the most closed position of the aim 5. Therefore, the arm angle θ2 is maximized when the aim 5 is most opened.

The bucket 6 is pivotably supported by the arm 5. A bucket angle sensor S3 is attached to the bucket 6. The bucket angle sensor S3 can detect a bucket angle θ3, which is the pivot angle of the bucket 6. The bucket angle θ3 is, for example, an opening angle from the most closed position of the bucket 6. Therefore, the bucket angle θ3 is maximized when the bucket 6 is most opened.

According to the example illustrated in FIGS. 1A and 1B, each of the boom angle sensor S1, the arm angle sensor S2, and the bucket angle sensor S3 is constituted of a combination of an acceleration sensor and a gyroscope. At least one of the boom angle sensor S1, the arm angle sensor S2, and the bucket angle sensor S3, however, may be constituted of an acceleration sensor alone. The boom angle sensor S1 may also be a stroke sensor attached to the boom cylinder 7 and may also be a rotary encoder, a potentiometer, an inertial measurement unit, or the like. The same applies to the arm angle sensor S2 and the bucket angle sensor S3.

A cabin 10 serving as a cab is provided and a power source such as an engine 11 is mounted on the upper swing structure 3. Furthermore, an object detector 70, an image capturing device 80, a machine body tilt sensor S4, a swing angular velocity sensor S5, etc., are attached to the upper swing structure 3. An operating device 26, a controller 30, a display device 40, a sound output device 43, etc., are provided in the cabin 10. In this specification, for convenience, the side on which the excavation attachment AT is attached is defined as the front side and the side on which a counterweight is attached is defined as the back side on the upper swing structure 3.

The object detector 70, which is an example of a surrounding area monitor (space recognition device), is configured to detect an object present in an area surrounding the shovel 100. Examples of objects include persons, animals, vehicles including dump trucks, construction machines, buildings, walls, fences, clay pipes, U-shaped gutters, trees such as plantings, and holes. The object detector 70 may also detect the presence or absence of an object, the shape of an object, the type of an object, the position of an object, or the like. Examples of the object detector 70 include a camera, an ultrasonic sensor, a millimeter wave radar, a stereo camera, a LIDAR, a distance image sensor, and an infrared sensor. According to this embodiment, the object detector 70 includes a front sensor 70F that is a LIDAR attached to the front end of the upper surface of the cabin 10, a back sensor 70B that is a LIDAR attached to the back end of the upper surface of the upper swing structure 3, a left sensor 70L that is a LIDAR attached to the left end of the upper surface of the upper swing structure 3, and a right sensor 70R that is a LIDAR attached to the right end of the upper surface of the upper swing structure 3. The front sensor 70F may be attached to the ceiling surface of the cabin 10, namely, the inside of the cabin 10.

The object detector 70 may also be configured to detect a predetermined object within a predetermined area set in an area surrounding the shovel 100. For example, the object detector 70 may also be configured to be able to distinguish between a person and an object other than a person. The object detector 70 may also be configured to calculate a distance from the object detector 70 or the shovel 100 to a recognized object.

The image capturing device 80, which is another example of a surrounding area monitor (space recognition device), is configured to capture an image of an area surrounding the shovel 100. According to this embodiment, the image capturing device 80 includes a back camera 80B attached to the back end of the upper surface of the upper swing structure 3, a left camera 80L attached to the left end of the upper surface of the upper swing structure 3, a right camera 80R attached to the right end of the upper surface of the upper swing structure 3, and a front camera 80F attached to the front end of the upper surface of the cabin 10. When the object detector 70 is a camera, the object detector 70 may also operate as the image capturing device 80. In this case, the image capturing device 80 may be integrated into the object detector 70. That is, the image capturing device 80 may be omitted.

The back camera 80B is placed next to the back sensor 70B. The left camera 80L is placed next to the left sensor 70L. The right camera 80R is placed next to the right sensor 70R. The front camera 80F is placed next to the front sensor 70F.

An image captured by the image capturing device 80 is displayed on the display device 40. The image capturing device 80 may also be configured to be able to display a viewpoint change image such as an overhead view image on the display device 40. The overhead view image is generated by, for example, combining the respective output images of the back camera 80B, the left camera 80L, and the right camera 80R.

The machine body tilt sensor S4 is configured to detect the tilt of the upper swing structure 3 relative to a predetermined plane. According to this embodiment, the machine body tilt sensor S4 is an acceleration sensor that detects the tilt angle about the longitudinal axis (roll angle) and the tilt angle about the lateral axis (pitch angle) of the upper swing structure 3 relative to a virtual horizontal plane. The longitudinal axis and the lateral axis of the upper swing structure 3, for example, pass through the central point of the shovel 100 that is a point on the swing axis of the shovel 100, crossing each other at right angles. The machine body tilt sensor S4 may be constituted of a combination of an acceleration sensor and a gyroscope. The machine body tilt sensor S4 may also be an inertial measurement unit.

The swing angular velocity sensor S5 is configured to detect the swing angular velocity of the upper swing structure 3. According to this embodiment, the swing angular velocity sensor S5 is a gyroscope. The swing angular velocity sensor S5 may also be a resolver, a rotary encoder, or the like. The swing angular velocity sensor S5 may also detect swing speed. The swing speed may be calculated from swing angular velocity.

In the following, each of the boom angle sensor S1, the arm angle sensor S2, the bucket angle sensor S3, the machine body tilt sensor S4, and the swing angular velocity sensor S5 is also referred to as a pose detector.

The display device 40 is configured to display a variety of information items. According to this embodiment, the display device 40 is a display installed in the cabin 10. The display device 40, however, may also be a projecting device such as a projector or a head-up display that projects an image onto the windshield of the cabin 10 or may also be a display attached to or embedded into the windshield of the cabin 10.

Figure 5A:
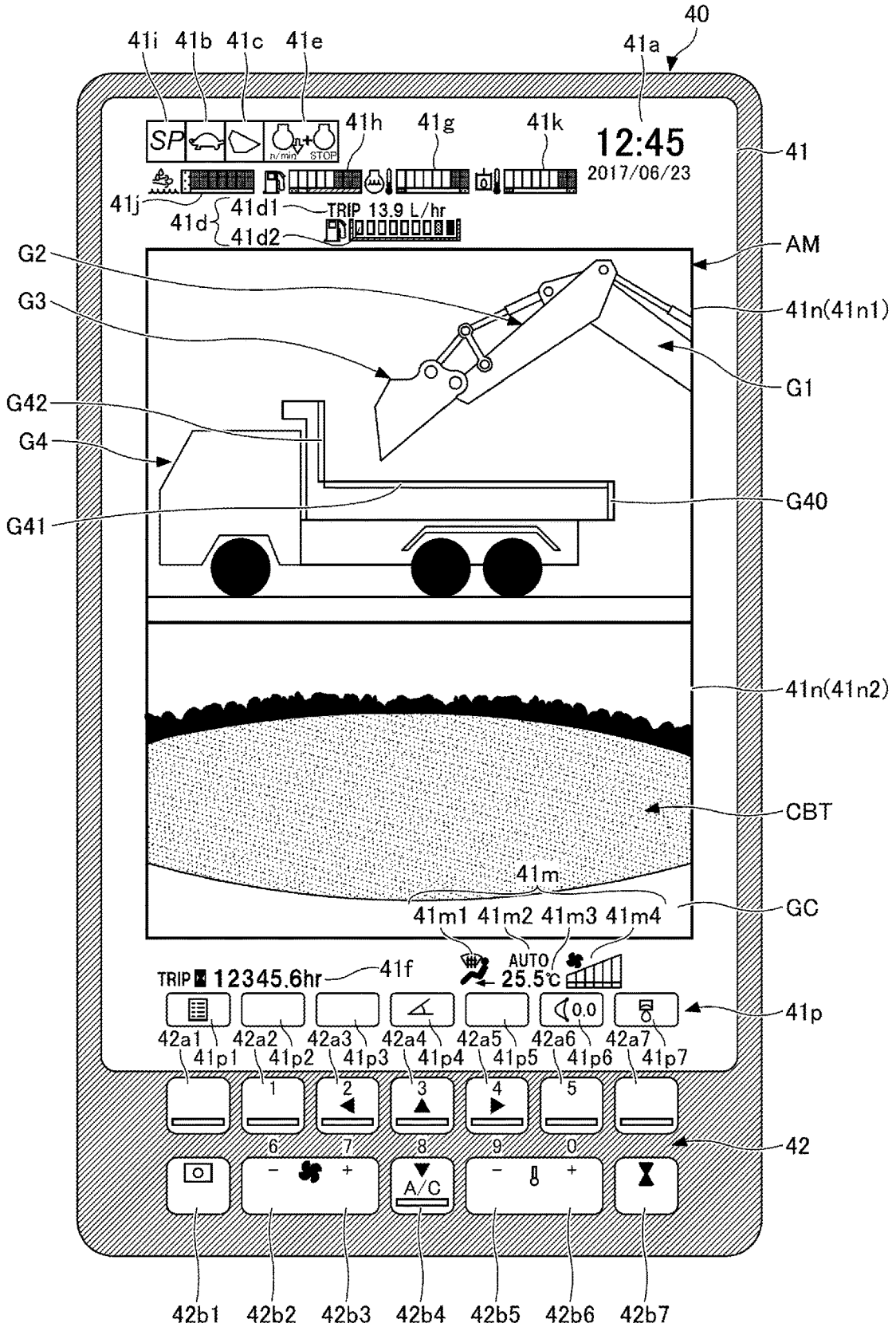
FIG. 5A is a diagram illustrating an example of an image displayed during loading work.

Specifically, the display device 40 includes a control part 40*a*, an image display part 41 (see FIG. 5A), and an operation part 42 (see FIG. 5A). The control part 40*a* controls an image displayed on the image display part 41. According to this embodiment, the control part 40*a* is constituted of a computer including a CPU, a volatile storage, and a non-volatile storage. The control part 40*a* reads programs corresponding to functions from the non-volatile storage, loads the programs into the volatile storage, and causes the CPU to execute corresponding processes.

The sound output device 43 is configured to output a sound. According to this embodiment, the sound output device 43 is a loudspeaker installed in the back of the cabin 10.

The operating device 26 is a device that an operator uses to operate actuators. The actuators include hydraulic actuators and electric actuators. Examples of hydraulic actuators include the swing hydraulic motor 2A, the travel hydraulic motors 2M, the boom cylinder 7, the arm cylinder 8, and the bucket cylinder 9. Examples of electric actuators include a swing electric motor.

The controller 30 is a control device for controlling the shovel 100. According to this embodiment, the controller 30 is constituted of a computer including a CPU, a volatile storage, and a non-volatile storage. The controller 30 reads programs corresponding to functions from the non-volatile storage and executes the programs. Examples of functions include a machine guidance function to guide (guide) the operator in manually operating the shovel 100 and a machine control function to autonomously assist the operator in manually operating the shovel 100.

Figure 2:
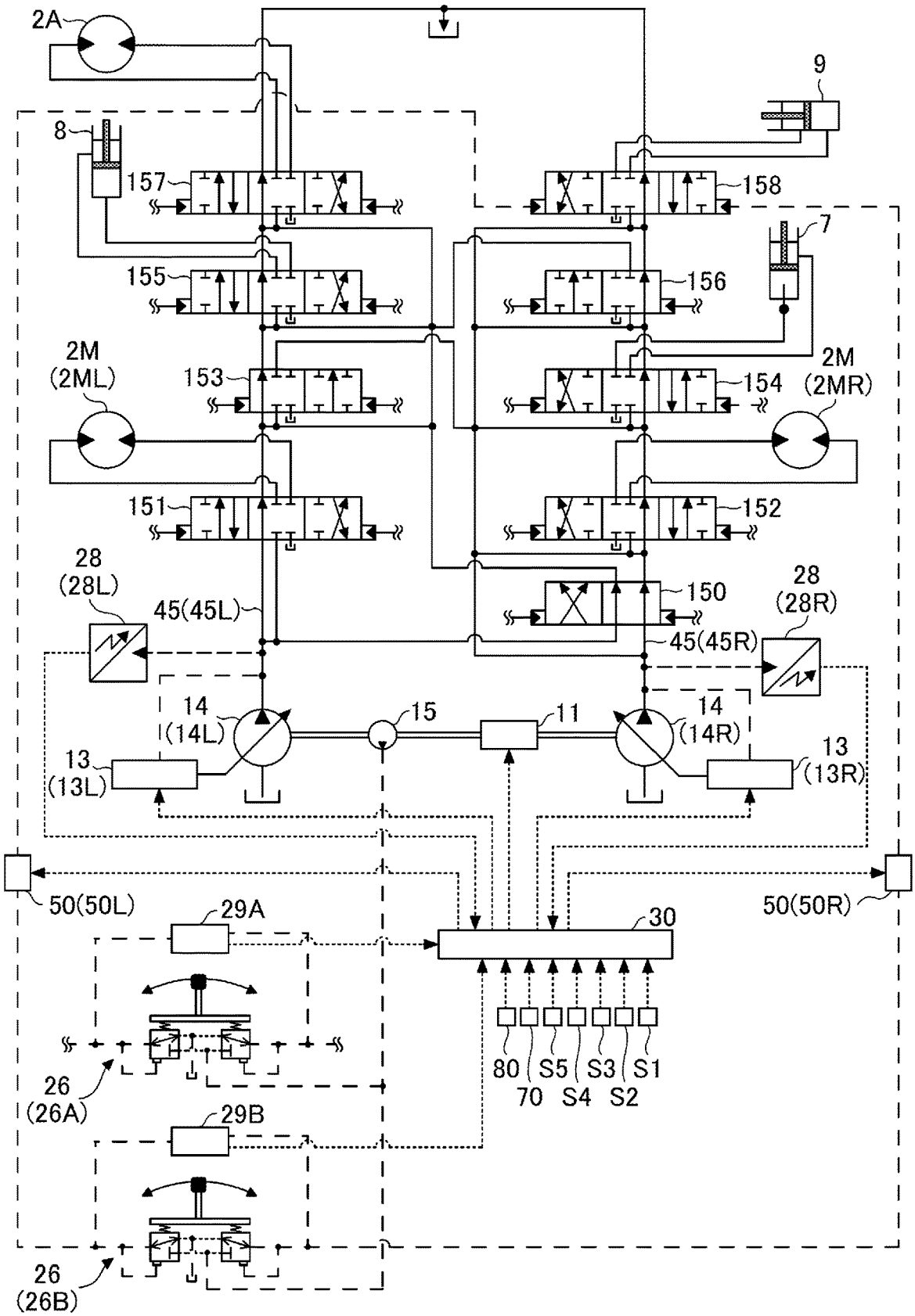
FIG. 2 is a diagram illustrating an example configuration of a hydraulic system installed in the shovel illustrated in FIG. 1A.

FIG. 2 is a diagram illustrating an example configuration of a hydraulic system installed in the shovel 100, in which a mechanical power transmission line, a hydraulic oil line, a pilot line, and an electrical control line are indicated by a double line, a solid line, a dashed line, and a dotted line, respectively.

The hydraulic system circulates hydraulic oil from a main pump 14 serving as a hydraulic pump driven by the engine 11 to a hydraulic oil tank via a center bypass conduit 45. The main pump 14 includes a left main pump 14L and a right main pump 14R. The center bypass conduit 45 includes a left center bypass conduit 45L and a right center bypass conduit 45R.

The left center bypass conduit 45L is a hydraulic oil line that passes through control valves 151, 153, 155 and 157 placed in a control valve unit. The right center bypass conduit 45R is a hydraulic oil line that passes through control valves 150, 152, 154, 156 and 158 placed in the control valve unit.

The control valve 150 is a straight travel valve. The control valve 151 is a spool valve that switches the flow of hydraulic oil in order to supply hydraulic oil discharged by the left main pump 14L to the left travel hydraulic motor 2ML and to discharge hydraulic oil in the left travel hydraulic motor 2ML to the hydraulic oil tank. The control valve 152 is a spool valve that switches the flow of hydraulic oil in order to supply hydraulic oil discharged by the left main pump 14L or the right main pump 14R to the right travel hydraulic motor 2MR and to discharge hydraulic oil in the right travel hydraulic motor 2MR to the hydraulic oil tank.

The control valve 153 is a spool valve that switches the flow of hydraulic oil in order to supply hydraulic oil discharged by the left main pump 14L to the boom cylinder 7. The control valve 154 is a spool valve that switches the flow of hydraulic oil in order to supply hydraulic oil discharged by the right main pump 14R to the boom cylinder 7 and to discharge hydraulic oil in the boom cylinder 7 to the hydraulic oil tank.

The control valve 155 is a spool valve that switches the flow of hydraulic oil in order to supply hydraulic oil discharged by the left main pump 14L to the arm cylinder 8 and to discharge hydraulic oil in the arm cylinder 8 to the hydraulic oil tank. The control valve 156 is a spool valve that switches the flow of hydraulic oil in order to supply hydraulic oil discharged by the right main pump 14R to the arm cylinder 8.

The control valve 157 is a spool valve that switches the flow of hydraulic oil in order to circulate hydraulic oil discharged by the left main pump 14L in the swing hydraulic motor 2A.

The control valve 158 is a spool valve that switches the flow of hydraulic oil in order to supply hydraulic oil discharged by the right main pump 14R to the bucket cylinder 9 and to discharge hydraulic oil in the bucket cylinder 9 to the hydraulic oil tank.

A regulator 13 controls the discharge quantity of the main pump 14 by adjusting the swash plate tilt angle of the main pump 14 in accordance with the discharge pressure of the main pump 14. According to the example illustrated in FIG. 2, the regulator 13 includes a left regulator 13L corresponding to the left main pump 14L and a right regulator 13R corresponding to the right main pump 14R.

A boom operating lever 26A is an operating device for extending and retracting the boom cylinder 7 to raise and lower the boom 4. The boom operating lever 26A introduces a control pressure commensurate with the amount of lever operation to a pilot port of the control valve 154 using hydraulic oil discharged by a pilot pump 15. This controls the amount of movement of a spool in the control valve 154 to control the flow rate of hydraulic oil supplied to the boom cylinder 7. The same is the case with the control valve 153. In FIG. 2, for clarification, the graphical representation of pilot lines connecting the boom operating lever 26A to the right and left pilot ports of the control valve 153 and the right and left pilot ports of the control valve 154 is omitted.

An operating pressure sensor 29A detects the details of the operator's operation on the boom operating lever 26A in the form of pressure and outputs a detected value to the controller 30. Examples of the details of operation include the direction of lever operation and the amount of lever operation (the operating angle of a lever).

A bucket operating lever 26B is an operating device for extending and retracting the bucket cylinder 9 to open and close the bucket 6. The bucket operating lever 26B introduces a control pressure commensurate with the amount of lever operation to a pilot port of the control valve 158 using hydraulic oil discharged by the pilot pump 15, for example. This controls the amount of movement of a spool in the control valve 158 to control the flow rate of hydraulic oil supplied to the bucket cylinder 9.

An operating pressure sensor 29B detects the details of the operator's operation on the bucket operating lever 26B in the form of pressure and outputs a detected value to the controller 30.

In addition to the boom operating lever 26A and the bucket operating lever 26B, the shovel 100 includes travel levers, travel pedals, an arm operating lever, and a swing operating lever (none of which is depicted). Like the boom operating lever 26A and the bucket operating lever 26B, these operating devices apply a control pressure commensurate with the amount of lever operation or the amount of pedal operation to a pilot port of a corresponding control valve using hydraulic oil discharged by the pilot pump 15. Furthermore, the details of the operator's operation on each of these operating devices are detected in the form of pressure by a corresponding operating pressure sensor similar to the operating pressure sensor 29A. Each operating pressure sensor outputs a detected value to the controller 30. In FIG. 2, for clarification, the graphical representation of pilot lines connecting these operating devices to the pilot ports of the corresponding control valves is omitted.

The controller 30 receives the outputs of the boom angle sensor S1, the arm angle sensor S2, the bucket angle sensor S3, the operating pressure sensor 29A, the operating pressure sensor 29B, discharge pressure sensors 28, etc., and suitably outputs control commands to the engine 11, the regulator 13, etc.

The controller 30 may output a control command to a pressure reducing valve 50 to adjust a control pressure applied to a corresponding control valve to control a corresponding actuator. In FIG. 2, the pressure reducing valve 50 includes a pressure reducing valve 50L and a pressure reducing valve 50R. Specifically, the controller 30 may output a control command to the pressure reducing valve 50L to adjust a control pressure applied to the left pilot port of the control valve 158 to control a bucket opening operation. Furthermore, the controller 30 may output a control command to the pressure reducing valve 50R to adjust a control pressure applied to the right pilot port of the control valve 158 to control a bucket closing operation. The same is the case with a boom raising operation, a boom lowering operation, an arm closing operation, an arm opening operation, a counterclockwise swing operation, a clockwise swing operation, a forward travel operation, and a backward travel operation.

Thus, the controller 30 can adjust a control pressure applied to a pilot port of a control valve with a pressure reducing valve. Therefore, the controller 30 can cause actuators to operate independent of the operator's manual operation on the operating device 26. The pressure reducing valve 50L and the pressure reducing valve 50R may be solenoid proportional valves.

Figure 3:
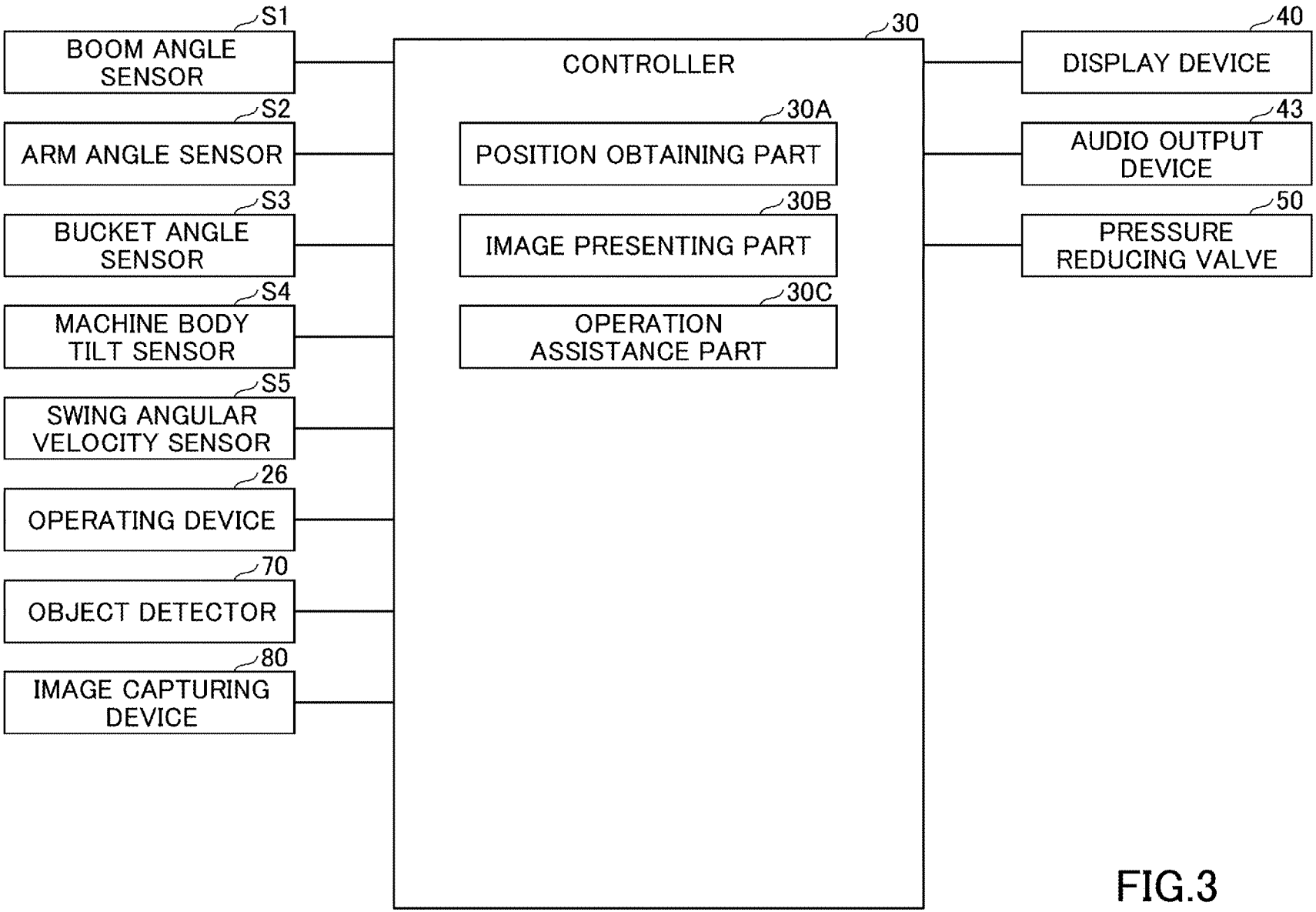
FIG. 3 is a functional block diagram of a controller.

Next, functions of the controller 30 are described with reference to FIG. 3. FIG. 3 is a functional block diagram of the controller 30. According to the example illustrated in FIG. 3, the controller 30 is configured to be able to receive the output signals of the pose detectors, the operating device 26, the object detector 70, the image capturing device 80, etc., execute various computations, and output control commands to the display device 40, the sound output device 43, the pressure reducing valve 50, etc. The pose detectors include the boom angle sensor S1, the arm angle sensor S2, the bucket angle sensor S3, the machine body tilt sensor S4, and the swing angular velocity sensor S5. The controller 30 includes a position obtaining part 30A, an image presenting part 30B, and an operation assistance part 30C as functional elements. Each functional element may be constituted of hardware or may be constituted of software.

The position obtaining part 30A is configured to obtain information on the position of an object. According to this embodiment, the position obtaining part 30A is configured to obtain information on the position of the bed of a dump truck positioned in front of the shovel 100 and information on the position of the bucket 6.

The information on the position of an object is expressed in coordinates in a frame of reference, for example. The frame of reference is, for example, a three-dimensional Cartesian coordinate system having its origin at the central point of the shovel 100. The central point of the shovel 100 may be, for example, the intersection of the virtual ground contacting surface and the swing axis of the shovel 100. The frame of reference may also be the World Geodetic System. The controller 30 may determine the coordinates of the central point of the shovel 100 based on the output of a GNSS receiver or the like attached to the shovel 100.

Specifically, the position obtaining part 30A obtains information on the position of the bed of the dump truck based on the coordinates of the known attachment position of the front sensor 70F in the frame of reference and the output of the front sensor 70F. The information on the position of the bed of the dump truck includes information on the position of at least one of a front panel, the bottom surface of the bed, a side gate, and a tailgate.

Alternatively, the position obtaining part 30A may obtain information on the position of the bed of the dump truck based on the coordinates of the known attachment position of the front camera 80F in the frame of reference and an image captured by the front camera 80F (hereinafter "front image"). In this case, the position obtaining part 30A, for example, obtains information on the position of the front panel by deriving the distance between the front camera 80F and the front panel by performing various kinds of image processing on the front image including an image of the front panel.

Furthermore, the position obtaining part 30A obtains information on the position of the bucket 6 based on the coordinates of the known attachment position of the attachment in the frame of reference and the output of pose detectors. The position obtaining part 30A may, for example, obtain information on the position of the bucket 6 by deriving the distance between the front camera 80F and the bucket 6 by performing various kinds of image processing on the front image including an image of the bucket 6.

The image presenting part 30B is configured to present a front area image that is an image of an area in front of the upper swing structure 3. According to this embodiment, the image presenting part 30B is configured to present an image representing the positional relationship between the bed of a dump truck positioned in front of the shovel 100 and the bucket 6 to the display device 40 as a front area image.

Specifically, the image presenting part 30B presents an illustration image that represents the positional relationship between the bed of the dump truck and the teeth tips of the bucket 6 as a front area image. The illustration image may be an animated image configured such that a graphic representing the bucket 6 moves according to the actual movement of the bucket 6.

The image presenting part 30B may also be configured to present an augmented reality image (hereinafter "AR image") serving as a front area image on the image of the bed of the dump truck included in the front image, using AR (augmented reality) techniques.

The AR image is, for example, a marker representing a position immediately below the teeth tips of the bucket 6. The AR image may include at least one of a marker representing a position a predetermined distance remoter than the position immediately below the teeth tips of the bucket 6 and a marker representing a position a predetermined distance closer than the position immediately below. In this case, the markers function as scale marks representing the distance from the position immediately below the teeth tips of the bucket 6. The markers functioning as scale marks may also be configured to represent the distance from the shovel 100. The AR image may also include a marker representing the position immediately below the teeth tips when the bucket 6 is opened to the maximum extent. The marker may be an arbitrary figure such as a solid line, a dashed line, a one-dot chain line, a circle, a quadrangle, or a triangle. Furthermore, the luminance, color, thickness, etc., of the marker may be arbitrarily set. The image presenting part 30B may be configured to display the marker in a flashing manner.

The image presenting part 30B may also be configured to present an AR image (for example, the above-described main marker) as if the AR image were present on the actual bed of the dump truck seen through the windshield, using AR (augmented reality) techniques, when a projector is used as the display device 40. That is, the image presenting part 30B may display the main marker on the bed of the dump truck using projection mapping techniques.

The image presenting part 30B may be implemented as a functional element included in the control part 40*a* of the display device 40.

The operation assistance part 30C is configured to assist the operator in operating the shovel 100. According to this embodiment, the operation assistance part 30C is configured to output an alarm when a predetermined condition regarding the positional relationship between the bed of the dump truck and the bucket 6 is satisfied. The predetermined condition is, for example, that the distance between the front panel of the bed of the dump truck and the bucket 6 is less than a predetermined value.

For example, in response to determining that the distance between the front panel of the bed of the dump truck and the bucket 6 has become less than a predetermined value, the operation assistance part 30C outputs a control command to the sound output device 43 to cause the sound output device 43 to output an alarm sound. The distance is, for example, a horizontal distance. The operation assistance part 30C may impart the size of the distance between the front panel and the bucket 6 to the operator by changing the interval, frequency (highness or lowness), etc., of sounds output by the sound output device 43 according to the size of the distance between the front panel and the bucket 6. For example, the operation assistance part 30C may output a control command to the display device 40 to cause the display device 40 to display an alert message in response to determining that the distance between the front panel and the bucket 6 has become less than a predetermined value.

For example, in response to determining that the distance between the front panel and the bucket 6 has become less than a predetermined value, the operation assistance part 30C may set an upper limit on the operating speed of the attachment. Specifically, the operation assistance part 30C may set an upper limit on the opening speed of the bucket 6. In this case, the operation assistance part 30C monitors the opening speed of the bucket 6 based on changes in the position of the teeth tips of the bucket 6 and outputs a control command to the pressure reducing valve 50L corresponding to the left pilot port of the control valve 158 when the opening speed reaches a predetermined upper limit value. In response to the reception of the control command, the pressure reducing valve 50L reduces a control pressure applied to the left pilot port of the control valve 158 to suppress the opening movement of the bucket 6. The operation assistance part 30C may also monitor the opening speed of the bucket 6 based on the output of the bucket angle sensor S3.

For example, in response to determining that the bucket 6 may contact the front panel, the operation assistance part 30C may stop the movement of the attachment. Specifically, for example, in response to determining that the distance between the front panel and the bucket 6 has become less than a predetermined value, the operation assistance part 30C may stop the movement of the attachment.

Figure 4A:
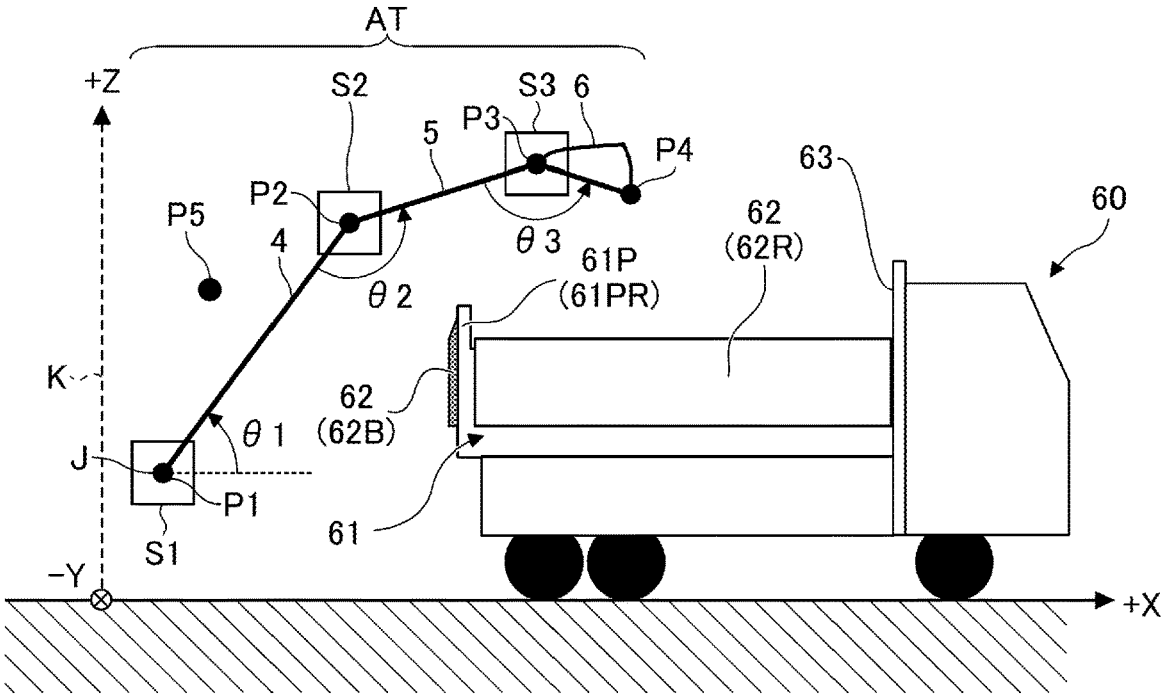
FIG. 4A is a diagram illustrating the positional relationship between the shovel and a dump truck.
Figure 4B:
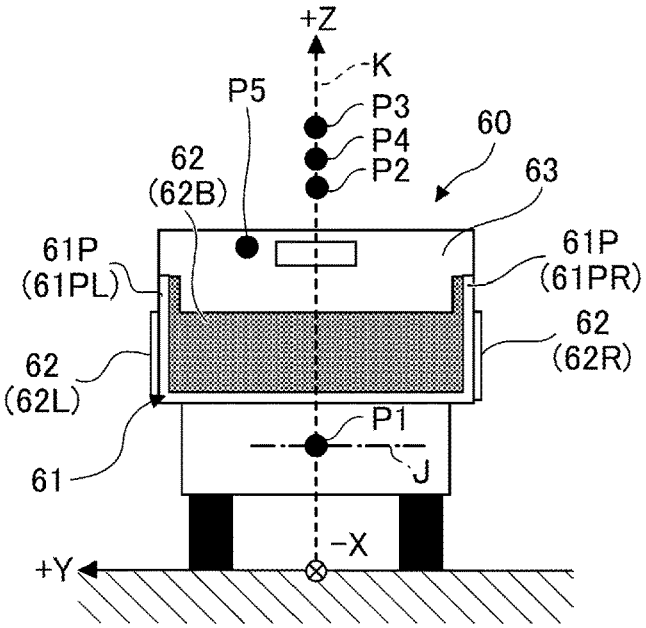
FIG. 4B is a diagram illustrating the positional relationship between the shovel and the dump truck.

Here, the positional relationship between the excavation attachment AT and a dump truck 60 when the image presenting part 30B presents an image is described with reference to FIGS. 4A and 4B. FIGS. 4A and 4B illustrate an example of the positional relationship between the excavation attachment AT and a dump truck 60 when the image presenting part 30B presents an image. According to the example illustrated in FIGS. 4A and 4B, the shovel 100 is positioned behind the dump truck 60 and has raised the bucket 6 over the bed of the dump truck 60. For clarification, FIGS. 4A and 4B illustrates the excavation attachment AT in a simplified model. Specifically, FIG. 4A is a right side view of the excavation attachment AT and the dump truck 60, and FIG. 4B is a rear view of the excavation attachment AT and the dump truck 60.

As illustrated in FIG. 4A, the boom 4 is configured to be pivotable about a pivot axis J parallel to the Y axis (the lateral axis of the upper swing structure 3). Likewise, the arm 5 is pivotably attached to the distal end of the boom 4, and the bucket 6 is pivotably attached to the distal end of the arm 5. The boom angle sensor S1 is attached to the connection of the upper swing structure 3 and the boom 4 at a position denoted by Point P1. The arm angle sensor S2 is attached to the connection of the boom 4 and the arm 5 at a position denoted by Point P2. The bucket angle sensor S3 is attached to the connection of the arm 5 and the bucket 6 at a position denoted by Point P3. Point P4 denotes the position of the leading edge (teeth tips) of the bucket 6. Point P5 denotes the attachment position of the front sensor 70F and the front camera 80F.

According to the example illustrated in FIG. 4A, the boom angle sensor S1 measures the angle between the longitudinal direction of the boom 4 and a reference horizontal plane (an XY plane) as the boom angle θ1. The arm angle sensor S2 measures the angle between the longitudinal direction of the boom 4 and the longitudinal direction of the arm 5 as the arm angle θ2. The bucket angle sensor S3 measures the angle between the longitudinal direction of the arm 5 and the longitudinal direction of the bucket 6 as the bucket angle θ3. The longitudinal direction of the boom 4 means the direction of a straight line passing through Point P1 and Point P2 in a plane perpendicular to the pivot axis J (an XZ plane). The longitudinal direction of the arm 5 means the direction of a straight line passing through Point P2 and Point P3 in the XZ plane. The longitudinal direction of the bucket 6 means the direction of a straight line passing through Point P3 and Point P4 in the XZ plane.

The controller 30 can derive the position of Point P1 relative to the central point of the shovel 100 based on the respective outputs of the machine body tilt sensor S4 and the swing angular velocity sensor S5, for example. The controller 30 can derive the respective positions of Point P2 through P4 relative to Point P1 based on the respective outputs of the boom angle sensor S1, the arm angle sensor S2, and the bucket angle sensor S3. Likewise, the controller 30 can derive the position of any part of the excavation attachment AT such as the end of the back surface of the bucket 6 relative to Point P1.

Furthermore, the controller 30 can derive the position of Point P5 relative to Point P1 based on the respective known attachment positions of the front sensor 70F and the front camera 80F.

According to the example illustrated in FIGS. 4A and 4B, the dump truck 60 includes a gate 62 attached to a bed 61. The gate 62, which is an openable and closable member constituting the sidewalls of the bed 61, includes a tailgate 62B, a left side gate 62L, and a right side gate 62R. Furthermore, the dump truck 60 includes pillars 61P formed at the back end of the bed 61. The pillars 61P, which are members supporting the tailgate 62B such that the tailgate 62B is openable and closable, include a left pillar 61PL and a right pillar 61PR. Furthermore, the dump truck 60 includes a front panel 63 that separates the bed 61 and a cab.

The controller 30 can derive the position of each part of the dump truck 60 relative to Point P1 based on the output of the front sensor 70F. Examples of parts of the dump truck 60 include the respective upper ends of the left end and the right end of the tailgate 62B, the upper end of the left side gate 62L, the upper end of the right side gate 62R, and the upper left end the upper right end of the front panel 63.

In this manner, the controller 30 can derive the coordinates of each part on the excavation attachment AT and the coordinates of each part of the dump truck 60 in the frame of reference.

Next, an example of providing guidance with respect to a dump truck detected as an object by a surrounding area monitor during loading work is described with reference to FIG. 5A. The loading work is the work of loading earth into the bed of the dump truck 60 by the shovel 100. FIG. 5A illustrates an example of an image displayed on the display device 40 during loading work.

The image display part 41 includes a date and time display area 41*a*, a travel mode display area 41*b*, an attachment display area 41*c*, a fuel efficiency display area 41*d*, an engine control status display area 41*e*, an engine operating time display area 41*f*, a coolant water temperature display area 41*g*, a remaining fuel amount display area 41*h*, a rotational speed mode display area 41*i*, a remaining aqueous urea solution amount display area 41*j*, a hydraulic oil temperature display area 41*k*, an air conditioner operating condition display area 41*m*, an image display area 41*n*, and a menu display area 41*p*.

Each of the travel mode display area 41*b*, the attachment display area 41*c*, the engine control status display area 41*e*, the rotational speed mode display area 41*i*, and the air conditioner operating condition display area 41*m* is an area for displaying settings information that is information on the settings of the shovel 100. Each of the fuel efficiency display area 41*d*, the engine operating time display area 41*f*, the coolant water temperature display area 41*g*, the remaining fuel amount display area 41*h*, the remaining aqueous urea solution amount display area 41*j*, and the hydraulic oil temperature display area 41*k* is an area for displaying operating condition information that is information on the operating condition of the shovel 100.

The date and time display area 41*a* is an area for displaying a current date and time. The travel mode display area 41*b* is an area for displaying a current travel mode. The attachment display area 41*c* is an area for displaying an image that represents a currently attached attachment. The fuel efficiency display area 41*d* is an area for displaying fuel efficiency information calculated by the controller 30. The fuel efficiency display area 41*d* includes an average fuel efficiency display area 41*d*1 for displaying average fuel efficiency with respect to the entire period or average fuel efficiency with respect to a partial period and an instantaneous fuel efficiency display area 41*d*2 for displaying instantaneous fuel efficiency. The entire period means, for example, the entirety of a period after the shipment of the shovel 100. The partial period means, for example, an arbitrary period set by the operator.

The engine control status display area 41*e* is an area for displaying the control status of the engine 11. The engine operating time display area 41*f* is an area for displaying information on the operating time of the engine 11. The coolant water temperature display area 41*g* is an area for displaying the current temperature condition of engine coolant water. The remaining fuel amount display area 41*h* is an area for displaying the state of the remaining amount of fuel stored in a fuel tank. The rotational speed mode display area 41*i* is an area for displaying a current rotational speed mode set with an engine rotational speed adjustment dial as an image. The remaining aqueous urea solution amount display area 41*j* is an area for displaying the state of the remaining amount of an aqueous urea solution stored in an aqueous urea solution tank as an image. The hydraulic oil temperature display area 41*k* is an area for displaying the state of the temperature of hydraulic oil in the hydraulic oil tank.

The air conditioner operating condition display area 41*m* includes a vent display area 41*m*1 for displaying a current vent position, an operating mode display area 41*m*2 for displaying a current operating mode, a temperature display area 41*m*3 for displaying a current set temperature, and an air volume display area 41*m*4 for displaying a current set air volume.

The image display area 41*n* is an area for displaying various images. Examples of various images include an image presented by the image presenting part 30B of the controller 30 and an image captured by the image capturing device 80. The image display area 41*n* includes a first image display area 41*n*1 positioned above and a second image display area 41*n*2 positioned below. According to the example illustrated in FIG. 5A, an illustration image AM created by the image presenting part 30B is displayed in the first image display area 41*n*1, and a back image CBT captured by the back camera 80B is displayed in the second image display area 41*n*2. However, the back image CBT may be displayed in the first image display area 41*n*1 and the illustration image AM may be displayed in the second image display area 41*n*2. Furthermore, the first image display area 41*n*1 and the second image display area 41*n*2, which are arranged vertically next to each other according to the example illustrated in FIG. 5A, may also be arranged, vertically spaced apart from each other.

The back image CBT is an image showing a space behind the shovel 100, and includes an image GC that represents part of the upper surface of the counterweight. According to this embodiment, the back image CBT is a real viewpoint image created by the control part 40*a*, and is created based on an image captured by the back camera 80B.

In the second image display area 41*n*2, an overhead view image may be displayed in place of the back image CBT. The overhead view image is a virtual viewpoint image created by the control part 40*a*, and is created based on images captured by the back camera 80B, the left camera 80L, and the right camera 80R. Furthermore, a shovel graphic corresponding to the shovel 100 is placed in the center of the overhead view image, in order to cause the operator to intuitively understand the positional relationship between the shovel 100 and an object present in an area surrounding the shovel 100.

The image display area 41*n*, which is a vertically elongated area according to the example illustrated in FIG. 5A, may also be a laterally elongated area. When the image display area 41*n* is a laterally elongated area, the image display area 41*n* may, for example, display the illustration image AM in the first image display area 41*n*1 on the left side and display the back image CBT in the second image display area 41*n*2 on the right side. In this case, the first image display area 41*n*1 and the second image display area 41*n*2 may be laterally arranged, spaced apart from each other. Furthermore, the first image display area 41*n*1 may be placed on the right side and the second image display area 41*n*2 may be placed on the left side.

The menu display area 41*p* includes tab areas 41*p*1 through 41*p*7. According to the example illustrated in FIG. 5A, the tab areas 41*p*1 through 41*p*7 are laterally arranged, spaced apart from each other at the bottom of the image display part 41. An icon representing the contents of associated information is displayed in each of the tab areas 41*p*1 through 41*p*7.

In the tab area 41*p*1, a menu specific item icon for displaying menu specific items is displayed. When the operator selects the tab area 41*p*1, the icons displayed in the tab areas 41*p*2 through 41*p*7 switch to icons associated with the menu specific items.

In the tab area 41*p*4, an icon for displaying digital level-related information is displayed. When the operator selects the tab area 41*p*4, the back image CBT switches to a first image showing the digital level-related information.

In the tab area 41*p*6, an icon for displaying intelligent construction-related information is displayed. When the operator selects the tab area 41*p*6, the back image CBT switches to a second image showing the intelligent construction-related information.

In the tab area 41*p*7, an icon for displaying crane mode-related information is displayed. When the operator selects the tab area 41*p*7, the back image CBT switches to a third image showing the crane mode-related information.

Any menu image such as the first image, the second image or the third image may be superimposed and displayed over the back image CBT. The back image CBT may also be reduced to make room for displaying the menu image. The image display area 41*n* may also be configured such that the illustration image AM switches to a menu image. The menu image may also be superimposed and displayed over the illustration image AM. The illustration image AM may also be reduced to make room for displaying the menu image.

No icons are displayed in the tab areas 41*p*2, 41*p*3, and 41*p*5. Therefore, even when the operator operates the tab area 41*p*2, 41*p*3, or 41*p*5, the image displayed on the image display part 41 does not change.

The icons displayed in the tab areas 41*p*1 through 41*p*7 are not limited to the above-described examples, and icons for showing other information may also be displayed.

According to the example illustrated in FIG. 5A, the operation part 42 is composed of multiple button switches for the operator making a selection from among the tab areas 41*p*1 through 41*p*7, inputting settings, etc. Specifically, the operation part 42 includes seven switches 42*a*1 through 42*a*7 placed in the upper row and seven switches 42*b*1 through 42*b*7 placed in the lower row. The switches 42*b*1 through 42*b*7 are placed below the switches 42*a*1 through 42*a*7, respectively. The number, form, and arrangement of switches of the operation part 42, however, are not limited to the above-described example. For example, like a jog wheel, a jog switch or the like, the operation part 42 may be a single unit into which the functions of multiple button switches are integrated. The operation part 42 may also be configured as a member independent of the display device 40. Furthermore, the tab areas 41*p*1 through 41*p*7 may be configured as software buttons. In this case, the operator can select desired tab areas by touching the tab areas 41*p*1 through 41*p*7.

According to the example illustrated in FIG. 5A, the switch 42*a*1 is placed below the tab area 41*p*1 to correspond to the tab area 41*p*1, and operates as a switch for selecting the tab area 41*p*1. The same is the case with each of the switches 42*a*2 through 42*a*7.

This configuration enables the operator to intuitively determine which of the switches 42*a*1 through 42*a*7 to operate to select a desired one of the tab areas 41*p*1 through 41*p*7.

The switch 42*b*1 is a switch for switching captured images displayed in the image display area 41*n*. The captured images mean images captured by the image capturing device 80. The display device 40 is configured such that the captured image displayed in the first image display area 41*n*1 of the image display area 41*n* switches among, for example, the back image CBT, a left image captured by the left camera 80L, a right image captured by the right camera 80R, and the illustration image AM each time the switch 42*b*1 is operated. The display device 40 may also be configured such that the captured image displayed in the second image display area 41*n*2 of the image display area 41*n* switches among, for example, the back image CBT, the left image, the right image, and the illustration image AM each time the switch 42*b*1 is operated. The display device 40 may also be configured such that the captured image displayed in the first image display area 41*n*1 of the image display area 41*n* and the captured image displayed in the second image display area 41*n*2 of the image display area 41*n* interchange each time the switch 42*b*1 is operated.

Thus, the operator may switch an image displayed in the first image display area 41*n*1 or the second image display area 41*n*2 by operating the switch 42*b*1 serving as the operation part 42. The operator may also switch images displayed in the first image display area 41*n*1 and the second image display area 41*n*2 by operating the switch 42*b*1. The display device 40 may include a separate switch for switching an image displayed in the second image display area 41*n*2.

The switches 42*b*2 and 42*b*3 are switches for controlling the air volume of an air conditioner. According to the example illustrated in FIG. 5A, the operation part 42 is configured such that the switch 42*b*2 is operated to decrease the air volume of the air conditioner and the switch 42*b*3 is operated to increase the air volume of the air conditioner.

The switch 42*b*4 is a switch for switching ON and OFF of a cooling/heating function. According to the example illustrated in FIG. 5A, the operation part 42 is configured such that each time the switch 42*b*4 is operated, the cooling/heating function switches between ON and OFF.

The switches 42*b*5 and 42*b*6 are switches for controlling the set temperature of the air conditioner. According to the example illustrated in FIG. 5A, the operation part 42 is configured such that the switch 42*b*5 is operated to decrease the set temperature and the switch 42*b*6 is operated to increase the set temperature.

The switch 42*b*7 is a switch for changing the contents of information on the operating time of the engine 11 displayed in the engine operating time display area 41*f*. The information on the operating time of the engine 11 includes, for example, a cumulative operating time for the entire period and a cumulative operating time for a partial period.

Furthermore, each of the switches 42*a*2 through 42*a*6 and 42*b*2 through 42*b*6 is configured to be able to input a number shown on or near the switch. Furthermore, the switches 42*a*3, 42*a*4, 42*a*5, and 42*b*4 are configured to be able to move a cursor left, up, right, and down, respectively, when the cursor is displayed on the image display part 41.

The functions assigned to the switches 42*a*1 through 42*a*7 and 42*b*1 through 42*b*7 are examples. The switches 42*a*1 through 42*a*7 and 42*b*1 through 42*b*7 may also be configured to be able to execute other functions.

Next, the details of the illustration image AM are described. The illustration image AM is an example of the front area image representing the positional relationship between the bed of a dump truck and the teeth tips of the bucket 6 presented by the image presenting part 30B. According to the example illustrated in FIG. 5A, the illustration image AM includes graphics G1 through G4.

The graphic G1 is a graphic representing an upper part of the boom 4 as viewed from the left side. According to the example illustrated in FIG. 5A, the graphic G1 is a graphic representing an upper part of the boom 4 including a part where an arm foot pin is attached, and includes a graphic representing the aim cylinder 8. That is, the graphic G1 does not include a graphic representing a lower part of the boom 4 including a part where a boom foot pin is attached and a part where an end of the boom cylinder 7 is attached. Furthermore, the graphic G1 does not include a graphic representing the boom cylinder 7. This is for increasing the visibility of the graphic representing an upper part of the boom 4, whose presentation to the operator is more needed during assistance with loading work, by simplifying the graphic G1 by omitting the display of a graphic representing a lower part of the boom 4, whose presentation to the operator is less needed during assistance with loading work. The graphic G1 may exclude the graphic representing the arm cylinder 8.

The graphic G1 is displayed in such a manner as to move according to the actual movement of the boom 4. Specifically, the controller 30 changes the position and pose of the graphic G1 according as the boom angle θ1 detected by the boom angle sensor S1 changes, for example.

The graphic G2 is a graphic representing the arm 5 as viewed from the left side. According to the example illustrated in FIG. 5A, the graphic G2 is a graphic representing the entirety of the aim 5, and includes a graphic representing the bucket cylinder 9. The graphic G2, however, may exclude the graphic representing the bucket cylinder 9.

The graphic G2 is displayed in such a manner as to move according to the actual movement of the arm 5. Specifically, the controller 30 changes the position and pose of the graphic G2 according as the boom angle θ1 detected by the boom angle sensor S1 changes and as the arm angle θ2 detected by the aim angle sensor S2 changes, for example.

The graphic G3 is a graphic representing the bucket 6 as viewed from the left side. According to the example illustrated in FIG. 5A, the graphic G3 is a graphic representing the entirety of the bucket 6, and includes a graphic representing a bucket link. The graphic G3, however, may exclude the graphic representing a bucket link.

The graphic G3 is displayed in such a manner as to move according to the actual movement of the bucket 6. Specifically, the controller 30 changes the position and pose of the graphic G3 according as the boom angle θ1 detected by the boom angle sensor S1 changes, as the arm angle θ2 detected by the aim angle sensor S2 changes, and as the bucket angle θ3 detected by the bucket angle sensor S3 changes, for example.

Thus, the illustration image AM is created in such a manner as to include a graphic of a distal part of the attachment, which is a part of the attachment except for its base part (proximal part). The proximal part of the attachment means a part of the attachment closer to the upper swing structure 3, and includes a lower part of the boom 4, for example. The distal part of the attachment means a part of the attachment distant from the upper swing structure 3, and includes an upper part of the boom 4, the arm 5, and the bucket 6, for example. This is for increasing the visibility of the graphic representing the distal part of the attachment, whose presentation to the operator is more needed during assistance with loading work, by simplifying the illustration image AM by omitting the display of a graphic representing the proximal part of the attachment, whose presentation to the operator is less needed during assistance with loading work.

The graphic G4 is a graphic representing the dump truck 60 as viewed from the left side. According to the example illustrated in FIG. 5A, the graphic G4 is a graphic representing the entirety of the dump truck 60, and includes a graphic G40 representing the tailgate 62B, a graphic G41 representing the left side gate 62L, and a graphic G42 representing the front panel 63. The graphic G4 may exclude a graphic representing a part other than the tailgate 62B, the left side gate 62L, and the front panel 63. Alternatively, the graphic G4 may exclude a graphic representing a part other than the left side gate 62L and the front panel 63. The graphic G4 may include a graphic (for example, a dashed line) that represents the bottom surface of the bed 61 of the dump truck 60, which is actually invisible.

The graphic G4 is displayed in such a manner as to move according to the actual movement of the dump truck 60. Specifically, the controller 30 changes the position and pose of the graphic G4 according as the output of at least one of the object detector 70 and the image capturing device 80 changes, for example. The controller 30 may be configured in such a manner as to be able to impart the stop position of the dump truck 60 to the driver of the dump truck 60. For example, the controller 30 may impart the size of the distance between the current position of the dump truck 60 and a position suitable for loading work to the driver of the dump truck 60, using a sound output device installed outside the cabin 10, by changing the interval, frequency (highness or lowness), etc., of sounds output by the sound output device.

The controller 30 may also change at least one of the positions, poses, and shapes of the graphics G1 through G4 according as the detection values of the machine body tilt sensor S4, the swing angular velocity sensor S5, etc., change. Furthermore, the controller 30 may also change at least one of the positions, poses, and shapes of the graphics G1 through G4 according to the difference between the level of the ground where the dump truck 60 is positioned and the level of the ground where the shovel 100 is positioned.

Multiple types may be prepared for each of the graphics G1 through G4. In this case, the type of the graphic G3 may be switched according to at least one of the type, size, etc., of the bucket 6, for example. Furthermore, the type of the graphic G4 may be switched according to at least one of the type, size, etc., of the dump truck 60, for example. The same is the case with the graphic G1 and the graphic G2.

The operator of the shovel 100, who looks at the illustration image AM as illustrated in FIG. 5A, can intuitively understand the size of the distance between the teeth tips of the bucket 6 represented by the graphic G3 and the upper end of the left side gate 62L represented by the graphic G41. Furthermore, the operator of the shovel 100 can intuitively understand the size of the distance between the teeth tips or the back surface of the bucket 6 and the front panel 63 represented by the graphic G42. Furthermore, when the illustration image AM includes a graphic representing the bottom surface of the bed 61, the operator of the shovel 100 can intuitively understand the size of the distance between the teeth tips of the bucket 6 and the bottom surface of the bed 61.

The graphics G1 through G4, which represent the state of the excavation attachment AT and the dump truck 60 as seen from the left side according to the example illustrated in FIG. 5A, may also represent the state of the excavation attachment AT and the dump truck 60 as seen from the right side or may also represent the state of the excavation attachment AT and the dump truck 60 as seen from directly above. Furthermore, at least two of the state as seen from the left side, the state as seen from the right side, and the state as seen from directly above may be simultaneously displayed.

Figure 5B:
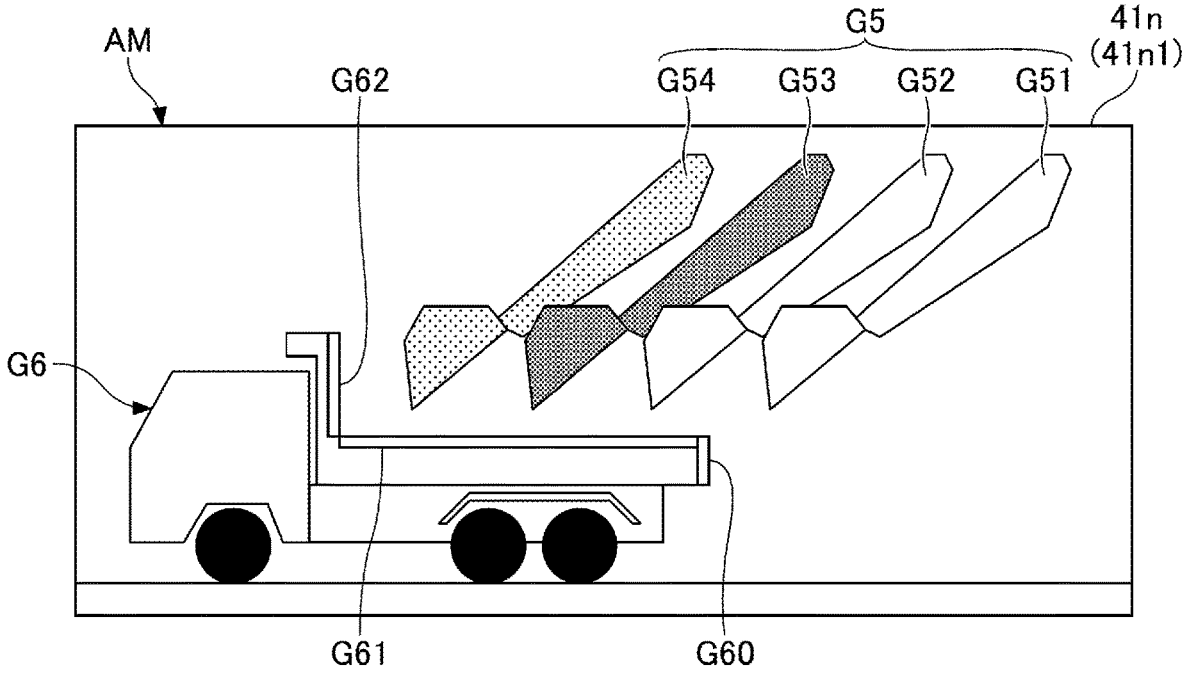
FIG. 5B is a diagram illustrating another example of the image displayed during loading work.

Next, another example of providing guidance with respect to a dump truck detected as an object by a surrounding area monitor during loading work is described with reference to FIG. 5B. FIG. 5B illustrates another example of the illustration image AM displayed in the image display area 41*n* of the display device 40 during loading work.

The illustration image AM illustrated in FIG. 5B is different from the illustration image AM illustrated in FIG. 5A, which includes the graphics G1 through G4 that are dynamically (variably) displayed, mainly in including a graphic G5 and a graphic G6 that are statically (fixedly) displayed.

The graphic G5 is a graphic representing a distal end part of the excavation attachment AT as viewed from the left side. According to the example illustrated in FIG. 5B, the graphic G5 is a graphic representing a part of the excavation attachment AT on the distal end side of an arm connection part at the distal end of the boom 4, namely, a simplified graphic representing the arm 5 and the bucket 6, and excludes a graphic including a bucket link and the bucket cylinder 9. The graphic of the bucket 6 included in the graphic G5 represents the bucket 6 in the practically most opened state. The bucket angle θ3 in the "practically most opened state" is the practically largest opening angle when the bucket 6 is opened during normal work such as dumping work, and is smaller than the bucket largest opening angle according to specifications that is the bucket angle θ3 in the most opened state according to specifications. During normal work, the bucket angle θ3 seldom exceeds the practically largest opening angle. Multiple types may be prepared for the graphic G5. In this case, the type of the graphic G5 may be switched according to at least one of the type, size, etc., of the bucket 6, for example.

Specifically, the graphic G5 includes graphics G51 through G54. The graphics G51 through G54 have the same size, pose, and shape. The respective poses of the graphics G51 through G54, however, may differ from one another to match the respective actual poses of the aim 5 and the bucket 6.

The graphics G51 through G54 are statically (fixedly) and simultaneously displayed in the first image display area 41*n*1 independent of the actual movement of the excavation attachment AT. On the other hand, the graphics G51 through G54 are displayed in such a manner as to change at least one of color, luminance, color density, etc., according to the actual movement of the excavation attachment AT so that the operator of the shovel 100 can recognize the actual positional relationship between the excavation attachment AT and the dump truck 60. Specifically, a graphic that represents the positional relationship closest to the actual positional relationship between the excavation attachment AT and the dump truck 60 among the graphics G51 through G54 is filled with a first color (for example, dark blue). Furthermore, a graphic that represents the positional relationship closest to the positional relationship between the excavation attachment AT and the dump truck 60 after passage of a predetermined period of time among the graphics G51 through G54 is filled with a second color (for example, light blue).

According to the example illustrated in FIG. 5B, the graphic G53 is filled with the first color as a graphic representing the positional relationship closest to the current positional relationship between the excavation attachment AT and the dump truck 60. Furthermore, the graphic G54 is filled with the second color as a graphic representing the positional relationship closest to the positional relationship between the excavation attachment AT and the dump truck 60 after passage of a predetermined period of time. The operator of the shovel 100 can understand the current positional relationship between the excavation attachment AT and the dump truck 60 by looking at the graphic G53 filled with the first color and can understand that the excavation attachment AT is moving toward the front panel 63 of the dump truck 60 by looking at the graphic G54 filled with the second color.

The graphic G6 is a graphic representing the dump truck 60 as viewed from the left side. According to the example illustrated in FIG. 5B, the graphic G6 is a graphic that represents the entirety of the dump truck 60, and includes a graphic G60 representing the tailgate 62B, a graphic G61 representing the left side gate 62L, and a graphic G62 representing the front panel 63. The graphic G6 may exclude a graphic that represents a part other than the tailgate 62B, the left side gate 62L, and the front panel 63. On the other hand, the graphic G6 may include a graphic (for example, a dashed line) that represents the bottom surface of the bed 61 of the dump truck 60, which is actually invisible.

The graphic G6 is statically (fixedly) displayed in the first image display area 41*n*1 independent of the actual movement of the dump truck 60. The graphic G6, however, may also be displayed in such a manner as to move according to the actual movement of the dump truck 60. Alternatively, the graphic G6 may not be displayed until the dump truck 60 arrives at a predetermined position and may be displayed when the dump truck 60 arrives at the predetermined position. The predetermined position is, for example, a position where the distance between the swing axis of the shovel 100 and the tailgate 62B of the dump truck 60 is a predetermined value.

Multiple types may be prepared for the graphic G6. In this case, the type of the graphic G6 may be switched according to at least one of the type, size, etc., of the dump truck 60, for example.

The operator of the shovel 100, who looks at the illustration image AM as illustrated in FIG. 5B, can roughly and intuitively understand the current positional relationship between the bucket 6 and the dump truck 60. Furthermore, the operator can intuitively understand that the bucket 6 is approaching the front panel 63 and can roughly understand the size of the distance between the bucket 6 and the front panel 63.

The graphic G5 and the graphic G6, which illustrate the state of the excavation attachment AT and the dump truck 60 as seen from the left side according to the example illustrated in FIG. 5B, may also represent the state of the excavation attachment AT and the dump truck 60 as seen from the right side or may also represent the state of the excavation attachment AT and the dump truck 60 as seen from directly above. Furthermore, at least two of the state as seen from the left side, the state as seen from the right side, and the state as seen from directly above may be simultaneously displayed.

Figure 5C:
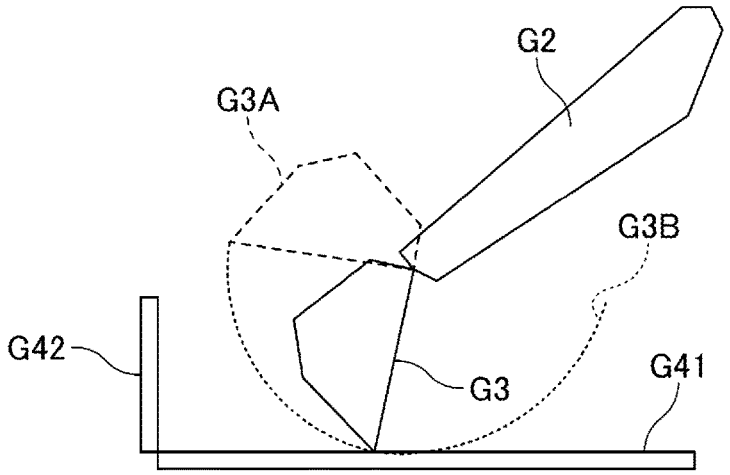
FIG. 5C is a diagram illustrating yet another example of the image displayed during loading work.

Next, yet another example of the illustration image AM is described with reference to FIG. 5C. FIG. 5C illustrates yet another example of the illustration image AM displayed in the image display area 41*n* of the display device 40 during loading work. Specifically, FIG. 5C is an enlarged view of part of the illustration image AM illustrated in FIG. 5A.

The illustration image AM illustrated in FIG. 5C is different from the illustration image AM illustrated in FIG. 5A mainly in including a graphic G3A and a graphic G3B. The graphic G3A and the graphic G3B are graphics related to the position of the bucket 6 when the bucket 6 is opened or closed from the current position of the bucket 6. Specifically, the graphic G3A represents the bucket 6 that is most opened according to specification. The graphic G3B illustrates the trajectory of the teeth tips of the bucket 6 when the bucket 6 is opened from the most closed state according to specifications to the most opened state according to specifications. According to the example illustrated in FIG. 5C, the graphic G3A, indicated by a dashed line, and the graphic G3B, indicated by a dotted line, are displayed, together with the graphic G3 representing the current state of the bucket 6, in such a manner as to move according to a change in the actual position of the bucket 6. Furthermore, during the opening and closing of the bucket 6, the graphic G3 is displayed in such a manner as to change its pose according to the actual degree of opening of the bucket 6, while the graphic G3A is displayed in such a manner as to maintain its pose independent of the actual degree of opening of the bucket 6. The graphic G3A and the graphic G3B may be displayed only when a predetermined condition is satisfied. The predetermined condition is, for example, that the distance between the bucket 6 and the front panel 63 falls below a predetermined value. This is for simplifying an illustration graphic when there is no risk of contact between the bucket 6 and the front panel 63.

For example, in response to determining that the above-described trajectory has interfered with the bed 61 of the dump truck 60, the operation assistance part 30C may output a control command to the sound output device 43 to cause the sound output device 43 to output an alarm sound or may output a control command to the display device 40 to cause the display device 40 to display an alert message.

The operator of the shovel 100, who looks at the illustration image AM as illustrated in FIG. 5C, can simultaneously and intuitively understand the size of the current distance between the bucket 6 and the front panel 63 and the size of the distance between the bucket 6 and the front panel 63 when the bucket 6 is opened to the maximum extent. Furthermore, by looking at the graphic G3B, the operator can easily understand the positional relationship between the teeth tips and the dump truck 60 when the bucket 6 is opened or closed. For example, the operator can easily determine whether the bucket 6 contacts the front panel 63 when the bucket 6 is opened to the maximum extent at the current position of the bucket 6. At least one of the graphic G3A and the graphic G3B may be added to the illustration image AM as illustrated in FIG. 5B.

The images illustrated in FIGS. 5A through 5C may be displayed on a display device attached to an assist device such as a portable terminal outside the shovel 100 used by a remote control operator, instead of the display device 40 installed in the cabin 10 of the shovel 100.

Figure 6A:
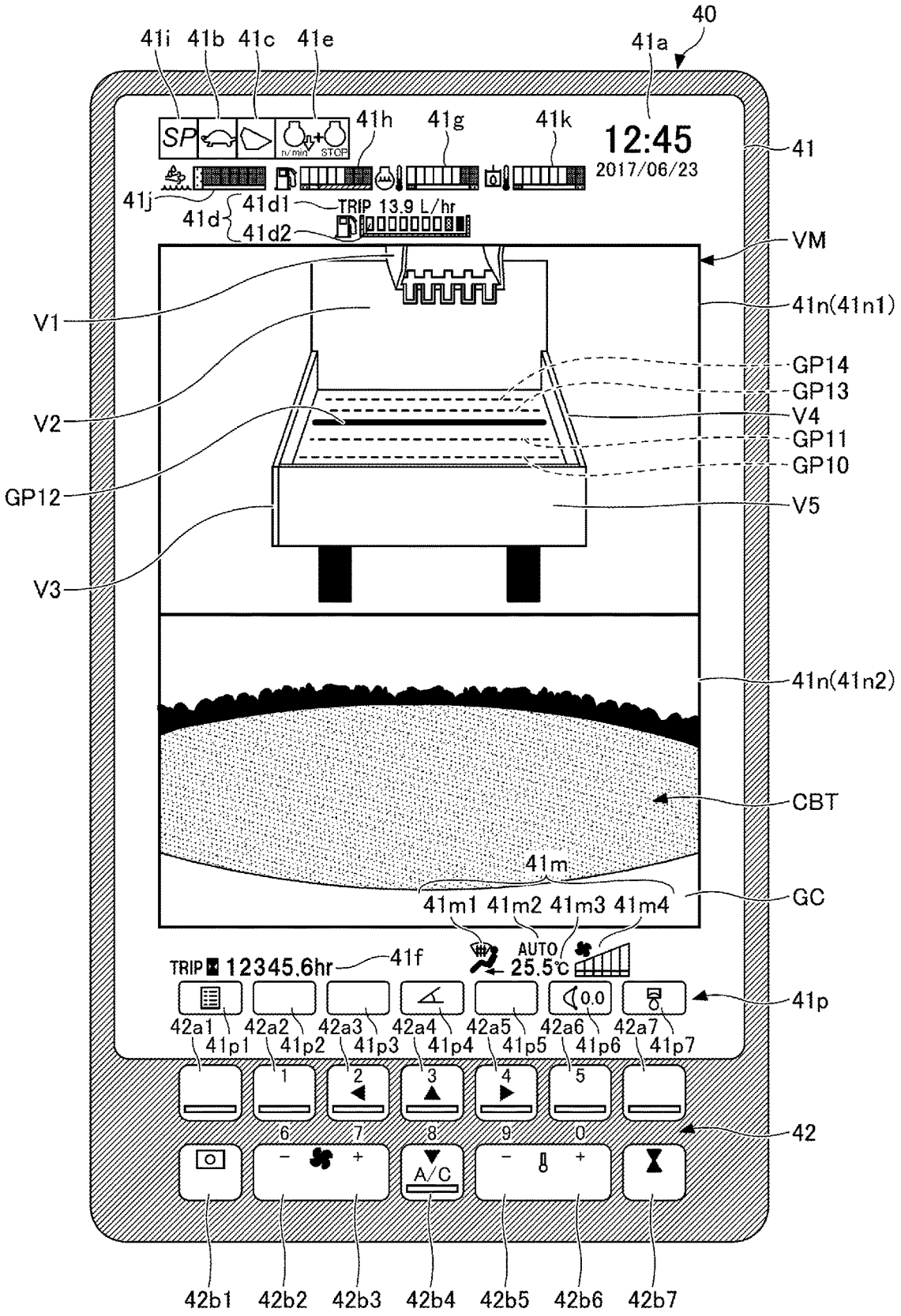
FIG. 6A is a diagram illustrating still another example of the image displayed during loading work.

Next, yet another example of providing guidance with respect to a dump truck detected as an object by a surrounding area monitor during loading work is described with reference to FIG. 6A. FIG. 6A illustrates an example of the image displayed in the image display area 41*n* of the display device 40 during loading work.

The image illustrated in FIG. 6A is mainly different in including a front image VM captured by the front camera 80F and graphics GP10 through GP14 as AR images superimposed and displayed over the front image VM from the image illustrated in FIG. 5A, which does not include the front image VM.

The front image VM illustrated in FIG. 6A includes an image of the dump truck 60 positioned in front of the shovel 100. Specifically, the front image VM includes images V1 through V5. The image V1 is an image of the bucket 6. The image V2 is an image of the front panel 63. The image V3 is an image of the left side gate 62L. The image V4 is an image of the right side gate 62R. The image V5 is an image of the tailgate 62B.

The graphics GP10 through GP14 are translucent dotted-line markers representing a distance from a reference point. The reference point is, for example, the central point of the shovel 100. The reference point may alternatively be the front end point or the rear end point of the bed 61 of the dump truck 60 or may alternatively be a survey point set in a construction site. According to the example illustrated in FIG. 6A, the graphic GP10 represents a position 3.0 m distant from the central point of the shovel 100, the graphic GP11 represents a position 3.5 m distant from the central point of the shovel 100, the graphic GP12 represents a position 4.0 m distant from the central point of the shovel 100, the graphic GP13 represents a position 4.5 m distant from the central point of the shovel 100, and the graphic GP14 represents a position 5.0 m distant from the central point of the shovel 100. That is, the graphics GP10 through GP14 are dotted-line markers equally spaced in a direction away from the reference point. According to the example illustrated in FIG. 6A, the graphics GP10 through GP14 are dotted-line markers arranged at intervals of 0.5 m in a direction away from the central point of the shovel 100.

The reference point may be calculated in view of the height of the dump truck 60 as an object. Specifically, the controller 30 may detect the position, shape (dimensions), or type of the dump truck 60 as an object with a surrounding area monitor. From the result of this detection, the controller 30 may detect the height of the dump truck 60 and calculate the central point of the shovel 100 in a plane positioned at the height of the dump truck 60 as the reference point. The graphics GP10 through GP14 may be displayed at regular intervals from this reference point.

Furthermore, the rear end point of the bed 61 of the dump truck 60 may be calculated as the reference point based on the detected height of the dump truck 60. In this case, the graphics GP10 through GP14 may be displayed at regular intervals from the rear end point serving as the reference point in the same plane on the bed 61 of the dump truck 60.

Specifically, the graphic GP10 may represent a position 1.0 m distant from the rear end point of the bed 61 of the dump truck 60, the graphic GP11 may represent a position 2.0 m distant from the rear end point of the bed 61 of the dump truck 60, the graphic GP12 may represent a position 3.0 m distant from the rear end point of the bed 61 of the dump truck 60, the graphic GP13 may represent a position 4.0 m distant from the rear end point of the bed 61 of the dump truck 60, and the graphic GP14 may represent a position 5.0 m distant from the rear end point of the bed 61 of the dump truck 60. That is, the graphics GP10 through GP14 serve as dotted-line markers equally spaced in a direction away from the rear end point of the bed 61 of the dump truck 60 serving as the reference point.

Furthermore, the controller 30 may detect the width of the bed 61 of the dump truck 60 and the depth of the bed 61 of the dump truck 60 based on the detection result of a surrounding area monitor. The graphics GP10 through GP14 are displayed based on the detected width of the bed 61 and the detected depth of the bed 61. In this case, display is performed such that the detected width of the bed 61 matches the width of the graphics GP10 through GP14. Thus, the controller 30 can correlate information such as the height, width, depth, etc., of the dump truck 60 as an object with dotted-line markers serving as guidance. Therefore, the controller 30 can display the graphics GP10 through GP14 at appropriate positions on the bed 61 of the dump truck 60. According to the above-described example, the controller 30 may calculate the reference point based on the height of the dump truck 60 alone or may calculate the reference point based on the height and width of the dump truck 60.

Furthermore, according to the example illustrated in FIG. 6A, of the graphics GP10 through GP14, the graphic GP12, which is the graphic closest to a position at which the position of the teeth tips of the bucket 6 is projected onto the bed 61 of the dump truck 60 (a position vertically below the teeth tips) is switched from a translucent dotted-line marker to a translucent solid-line marker.

The operator of the shovel 100, who looks at the front image VM as illustrated in FIG. 6A, can intuitively understand that the position vertically below the teeth tips of the bucket 6 is near a position a predetermined distance (4.0 m in the example illustrated in FIG. 6A) away from the shovel 100. Furthermore, when the reference point is the rear end point of the dump truck 60, the operator can intuitively understand that the position vertically below the teeth tips of the bucket 6 is near a position a predetermined distance away from the rear end point of the dump truck 60.

The images illustrated in FIG. 6A may be displayed on a display device attached to an assist device such as a portable terminal outside the shovel 100 used by a remote control operator, instead of the display device 40 installed in the cabin 10.

Figure 6B:
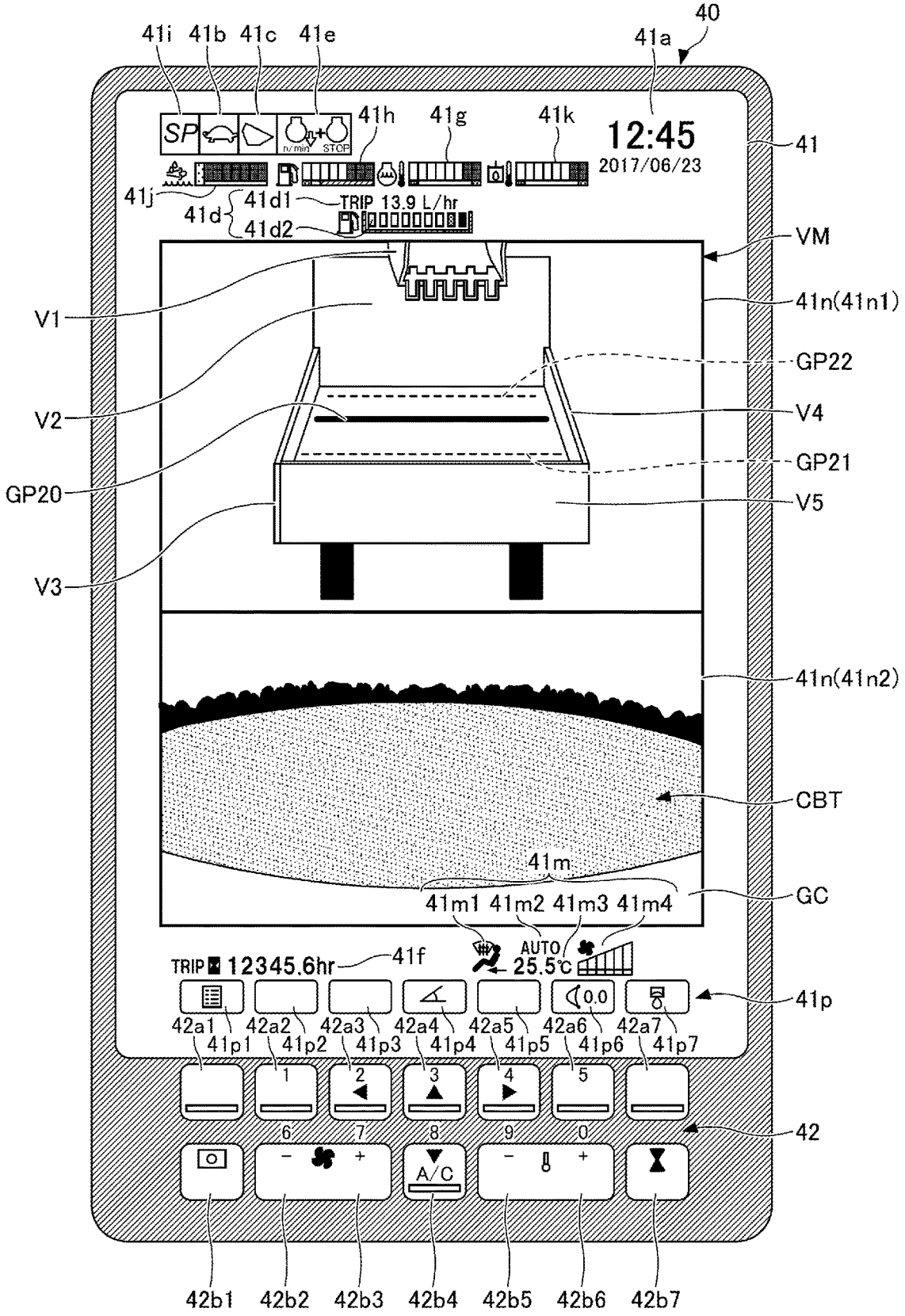
FIG. 6B is a diagram illustrating still yet another example of the image displayed during loading work.

Next, still another example of providing guidance with respect to a dump truck detected as an object by a surrounding area monitor during loading work is described with reference to FIG. 6B. FIG. 6B illustrates another example of the image displayed in the image display area 41*n* of the display device 40 during loading work, and corresponds to FIG. 6A. Specifically, the image illustrated in FIG. 6B is different from the image illustrated in FIG. 6A in that graphics GP20 through GP22 are displayed instead of the graphics GP10 through GP14, but otherwise, is equal to the image illustrated in FIG. 6A. Accordingly, a description of a common portion is omitted, and differences are described in detail.

The graphic GP20 is a translucent solid-line marker representing a position immediately below the teeth tips of the bucket 6. The graphic GP21 is a dashed-line marker representing a position a predetermined first distance away from the central point of the shovel 100. The graphic GP22 is a translucent dashed-line marker representing a position a predetermined second distance, which is greater than the first distance, away from the central point of the shovel 100. The graphic GP21 and the graphic GP22 may be graphics related to the positions of the bucket 6 when the bucket 6 is opened and closed from the current position of the bucket 6. For example, the graphic GP21 may be a marker that represents a position immediately below the teeth tips of the bucket 6 when the bucket 6 is closed to the maximum extent from the current position of the bucket 6. Furthermore, the graphic GP22 may be a marker that represents a position immediately below the teeth tips of the bucket 6 when the bucket 6 is opened to the maximum extent from the current position of the bucket 6. According to the example illustrated in FIG. 6B, each of the graphics GP20 through GP22 is displayed in such a manner as to extend over the entire width of the bed 61 of the dump truck 60. The area between the graphic GP20 and the graphic GP21 may be filled with a predetermined translucent color. The same is the case with the area between the graphic GP20 and the graphic GP22. The area between the graphic GP20 and the graphic GP21 and the area between the graphic GP20 and the graphic GP22 may be filled with different translucent colors.

The reference point may be calculated in view of the height of the dump truck 60 as an object. Specifically, the controller 30 may detect the position, shape (dimensions), or type of the dump truck 60 as an object with a surrounding area monitor. From the result of this detection, the controller 30 may detect the height of the dump truck 60 and calculate the central point of the shovel 100 in a plane positioned at the height of the dump truck 60 as the reference point. The graphics GP20 through GP22 may be displayed at regular intervals from this reference point.

The operator of the shovel 100, who looks at the front image VM as illustrated in FIG. 6B, can intuitively understand that the position vertically below the teeth tips of the bucket 6 is located between the position the first distance away from and the position the second distance away from the shovel 100.

The images illustrated in FIG. 6B may be displayed on a display device attached to an assist device such as a portable terminal outside the shovel 100 used by a remote control operator, instead of the display device 40 installed in the cabin 10 of the shovel 100.

Figure 6C:
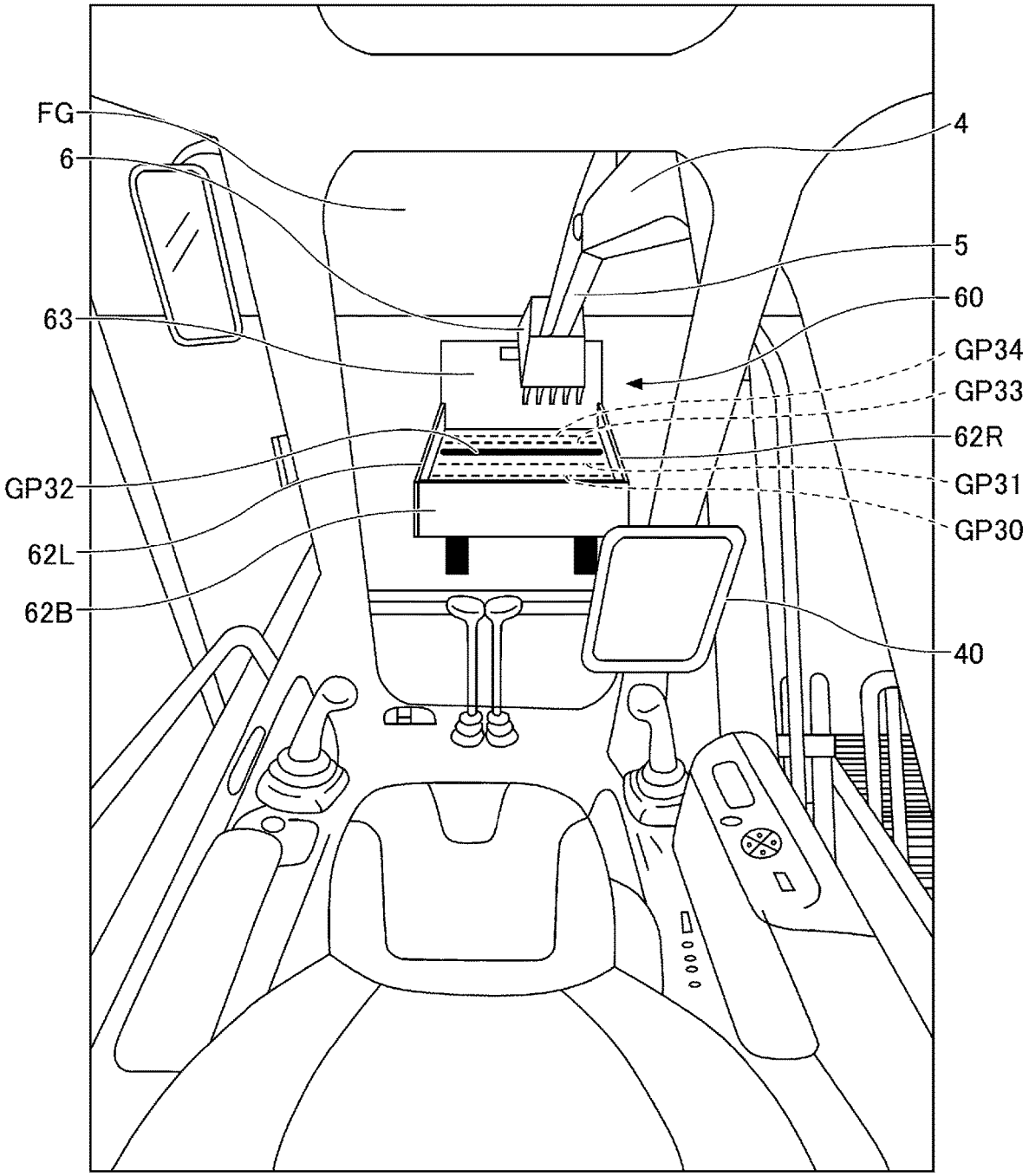
FIG. 6C is a diagram illustrating still yet another example of the image displayed during loading work.

Next, still yet another example of providing guidance with respect to a dump truck detected as an object by a surrounding area monitor during loading work is described with reference to FIG. 6C. FIG. 6C is a diagram illustrating the inside of the cabin 10 during loading work. Specifically, FIG. 6C illustrates a state where an AR image is displayed on a windshield FG of the cabin 10.

The operator in the cabin 10 is looking at the boom 4, the arm 5, the bucket 6, and the dump truck 60 through the windshield FG. Specifically, the operator seated in an operator seat in the cabin 10 is visually recognizing that the teeth tips of the bucket 6 are positioned immediately above the bed 61 of the dump truck 60 delimited by the tailgate 62B, the left side gate 62L, the right side gate 62R, and the front panel 63 through the windshield FG. Furthermore, the operator is also visually recognizing markers (an AR image) displayed as if to really exist on the bed 61 of the dump truck 60.

The AR image illustrated in FIG. 6C is projected onto the windshield FG using a projector. The AR image illustrated in FIG. 6C, however, may also be displayed using a display device such as a transmissive organic EL display or a transmissive liquid crystal display attached to the windshield FG.

The AR image illustrated in FIG. 6C mainly includes graphics GP30 through GP34. The graphics GP30 through GP34 correspond to the graphics GP10 through GP14 illustrated in FIG. 6A. Specifically, the graphic GP30 represents a position 3.0 m distant from the central point of the shovel 100, the graphic GP31 represents a position 3.5 m distant from the central point of the shovel 100, the graphic GP32 represents a position 4.0 m distant from the central point of the shovel 100, the graphic GP33 represents a position 4.5 m distant from the central point of the shovel 100, and the graphic GP34 represents a position 5.0 m distant from the central point of the shovel 100. That is, the graphics GP30 through GP34 are dotted-line markers equally spaced in a direction away from the reference point. According to the example illustrated in FIG. 6C, the graphics GP30 through GP34 are dotted-line markers arranged at intervals of 0.5 m in a direction away from the central point of the shovel 100.

The reference point is calculated in view of the height of the dump truck 60 as an object. Specifically, the controller 30 may detect the position, shape (dimensions), or type of the dump truck 60 as an object with a surrounding area monitor. From the result of this detection, the controller 30 may detect the height of the dump truck 60 and calculate the central point of the shovel 100 in a plane positioned at the height of the dump truck 60 as the reference point. The graphics GP30 through GP34 may be displayed at regular intervals from this reference point.

Furthermore, the controller 30 may calculate the rear end point of the bed 61 of the dump truck 60 as the reference point based on the detected height of the dump truck 60. In this case, the graphics GP30 through GP34 may be displayed at regular intervals from the rear end point serving as the reference point in the same plane on the bed 61 of the dump truck 60.

Specifically, the graphic GP30 may represent a position 1.0 m distant from the rear end point of the bed 61 of the dump truck 60, the graphic GP31 may represent a position 2.0 m distant from the rear end point of the bed 61 of the dump truck 60, the graphic GP32 may represent a position 3.0 m distant from the rear end point of the bed 61 of the dump truck 60, the graphic GP33 may represent a position 4.0 m distant from the rear end point of the bed 61 of the dump truck 60, and the graphic GP34 may represent a position 5.0 m distant from the rear end point of the bed 61 of the dump truck 60. That is, the graphics GP30 through GP34 serve as dotted-line markers equally spaced in a direction away from the rear end point of the bed 61 of the dump truck 60 serving as the reference point.

Furthermore, the controller 30 may detect the width of the bed 61 of the dump truck 60 and the depth of the bed 61 of the dump truck 60 based on the detection result of a surrounding area monitor. The graphics GP30 through GP34 are displayed based on the detected width of the bed 61 and the detected depth of the bed 61. In this case, display is performed such that the detected width of the bed 61 matches the width of the graphics GP30 through GP34. Thus, the controller 30 can correlate information such as the height, width, depth, etc., of the dump truck 60 as an object with dotted-line markers serving as guidance. Therefore, the controller 30 can display the graphics GP30 through GP34 at appropriate positions on the bed 61 of the dump truck 60. According to the above-described example, the controller 30 may calculate the reference point based on the height of the dump truck 60 alone or may calculate the reference point based on the height and width of the dump truck 60.

Furthermore, according to the example illustrated in FIG. 6C, of the graphics GP30 through GP34, the graphic GP32, which is the graphic closest to the position vertically below the teeth tips of the bucket 6 is switched from a translucent dotted-line marker to a translucent solid-line marker.

The operator of the shovel 100, who looks at the AR image as illustrated in FIG. 6C, can intuitively understand that the position vertically below the teeth tips of the bucket 6 is near a position a predetermined distance (4.0 m in the example illustrated in FIG. 6C) away from the shovel 100, the same as in the case of looking at the front image VM as illustrated in FIG. 6A. Furthermore, when the reference point is the rear end point of the dump truck 60, the operator can intuitively understand that the position vertically below the teeth tips of the bucket 6 is near a position a predetermined distance away from the rear end point of the dump truck 60.

Figure 6D:
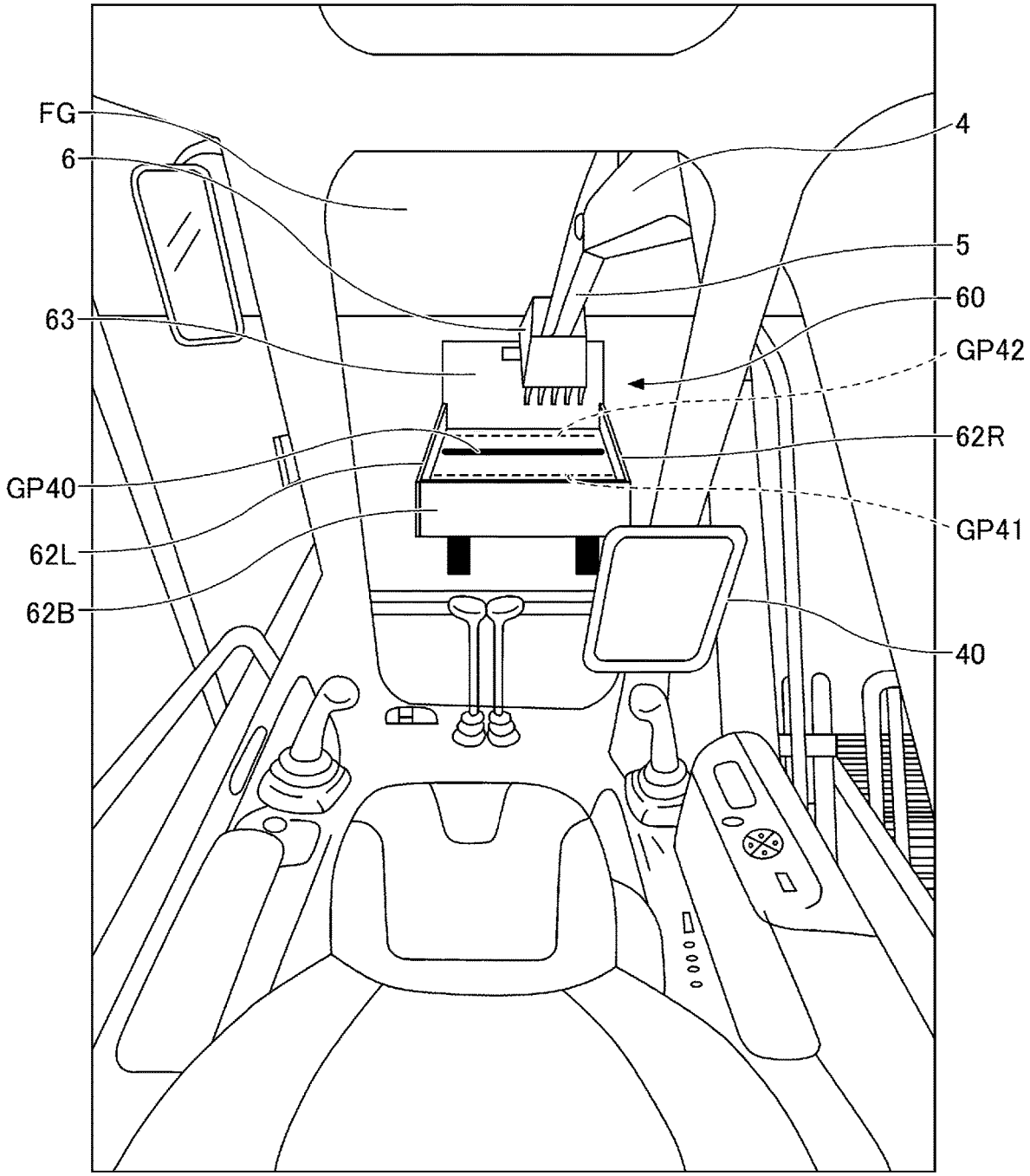
FIG. 6D is a diagram illustrating still yet another example of the image displayed during loading work.

Next, still yet another example of providing guidance with respect to a dump truck detected as an object by a surrounding area monitor during loading work is described with reference to FIG. 6D. FIG. 6D is a diagram illustrating the inside of the cabin 10 during loading work, and corresponds to FIG. 6C.

The AR image illustrated in FIG. 6D mainly includes graphics GP40 through GP42. The graphics GP40 through GP42 correspond to the graphics GP20 through GP22 illustrated in FIG. 6B. Specifically, the graphic GP40 is a translucent solid-line marker representing a position immediately below the teeth tips of the bucket 6. The graphic GP41 is a translucent dashed-line marker representing a position a predetermined first distance away from the central point of the shovel 100. The graphic GP42 is a translucent dashed-line marker representing a position a predetermined second distance, which is greater than the first distance, away from the central point of the shovel 100. The graphic GP41 and the graphic GP42 may be graphics related to the positions of the bucket 6 when the bucket 6 is opened and closed from the current position of the bucket 6. For example, the graphic GP41 may be a marker that represents a position immediately below the teeth tips of the bucket 6 when the bucket 6 is closed to the maximum extent from the current position of the bucket 6. Furthermore, the graphic GP42 may be a marker that represents a position immediately below the teeth tips of the bucket 6 when the bucket 6 is opened to the maximum extent from the current position of the bucket 6. The area between the graphic GP40 and the graphic GP41 may be filled with a predetermined translucent color. The same is the case with the area between the graphic GP40 and the graphic GP42. The area between the graphic GP40 and the graphic GP41 and the area between the graphic GP40 and the graphic GP42 may be filled with different translucent colors.

The reference point may be calculated in view of the height of the dump truck 60 as an object. Specifically, the controller 30 may detect the position, shape (dimensions), or type of the dump truck 60 as an object with a surrounding area monitor. From the result of this detection, the controller 30 may detect the height of the dump truck 60 and calculate the central point of the shovel 100 in a plane positioned at the height of the dump truck 60 as the reference point. The graphics GP40 through GP42 may be displayed at regular intervals from this reference point.

The operator of the shovel 100, who looks at the AR image as illustrated in FIG. 6D, can intuitively understand that the position at which the position of the teeth tips of the bucket 6 is projected onto the bed 61 of the dump truck 60 is located between the position the first distance away from and the position the second distance away from the shovel 100, the same as in the case of looking at the front image VM as illustrated in FIG. 6B. Furthermore, when the reference point is the rear end point of the dump truck 60, the operator can intuitively understand that the position at which the position of the teeth tips of the bucket 6 is projected onto the bed 61 of the dump truck 60 is located between the position the first distance away from and the position the second distance away from the rear end point of the dump truck 60.

Figure 6E:
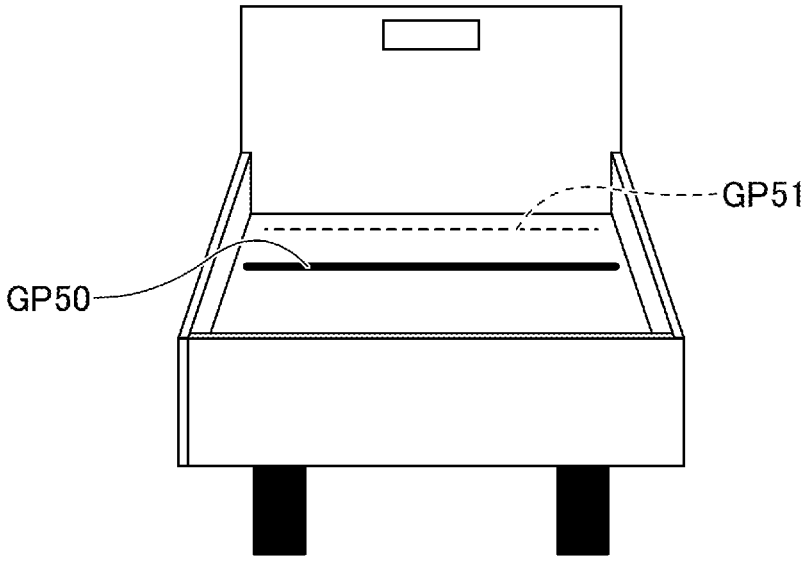
FIG. 6E is a diagram illustrating still yet another example of the image displayed during loading work.

Next, still yet another example of providing guidance with respect to a dump truck detected as an object by a surrounding area monitor during loading work is described with reference to FIG. 6E. FIG. 6E illustrates another example of the AR image illustrated in FIG. 6A, 6B, 6C or 6D.

The AR image illustrated in FIG. 6E is different from the AR image illustrated in each of FIGS. 6A through 6D in including a graphic GP51 representing a position immediately below the teeth tips when the bucket 6 is opened to the maximum extent.

Specifically, the AR image illustrated in FIG. 6E includes a graphic GP50 and a graphic GP51. The graphic GP50 is a translucent solid-line marker representing a position immediately below the teeth tips of the bucket 6. The graphic GP51 is a graphic related to the position of the bucket 6 when the bucket 6 is opened from the current position of the bucket 6. Specifically, the graphic GP51 is a translucent dashed-line marker representing a position immediately below the teeth tips when the bucket 6 is opened to the maximum extent. The AR image illustrated in FIG. 6E may also include a graphic such as a marker that represents a position immediately below the teeth tips when the bucket 6 is closed to the maximum extent.

The operator of the shovel 100, who looks at the AR image as illustrated in FIG. 6E, can simultaneously and intuitively understand a position at which the position of the teeth tips of the bucket 6 is projected onto the bed 61 of the dump truck 60 vertically below and a position at which the position of the teeth tips of the bucket 6 when the bucket 6 is opened to the maximum extent is projected onto the bed 61 of the dump truck 60 vertically below. Therefore, the operator can easily determine whether there is no risk of contact between the bucket 6 and the front panel 63 of the dump truck 60 even when the bucket 6 is opened to dump an excavated object such as earth scooped into the bucket 6, for example.

Figure 7:
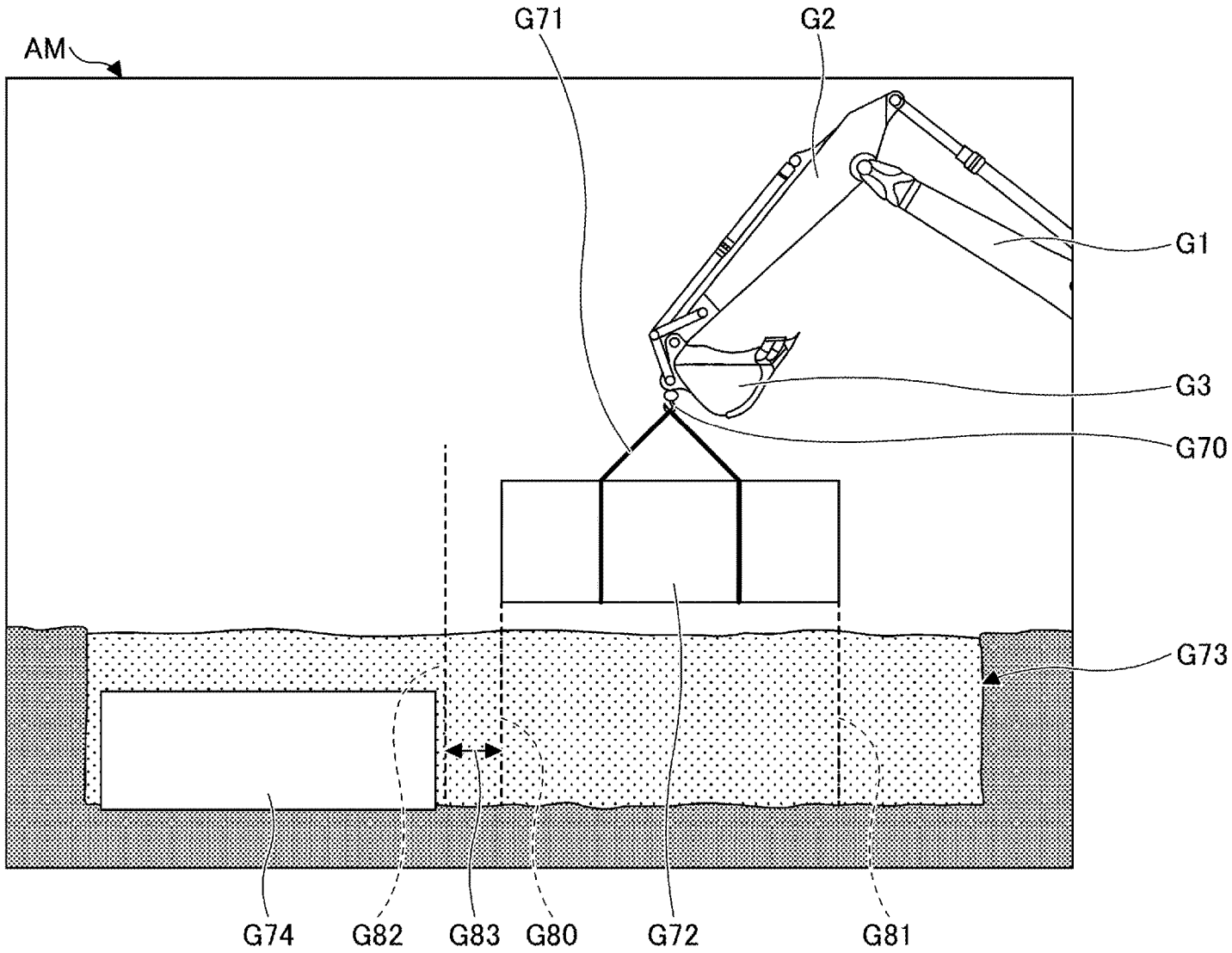
FIG. 7 is a diagram illustrating an example of an image displayed during crane work.

Next, still another example of the illustration image AM is described with reference to FIG. 7. FIG. 7 illustrates an example of the illustration image AM serving as guidance on crane work displayed in the image display area 41*n* of the display device 40 during crane work. The crane work is the work of hoisting and moving a suspended load by the shovel 100. The suspended load is, for example, a water conduit pipe such as a clay pipe or a hume pipe.

According to the example illustrated in FIG. 7, the illustration image AM is an example of a front area image that represents the positional relationship between a water conduit tube hoisted by the shovel 100 and a water conduit pipe already installed (hereinafter "existing water conduit pipe") in an excavated trench formed in the ground, presented by the image presenting part 30B. According to the example illustrated in FIG. 7, the illustration image AM includes the graphics G1 through G3, graphics G70 through G74, and graphics G80 through G82.

The graphic G1 is a graphic representing an upper part of the boom 4 as viewed from the left side. According to the example illustrated in FIG. 7, the graphic G1 is a graphic representing an upper part of the boom 4 including a part where an arm foot pin is attached, and includes a graphic representing the arm cylinder 8. That is, the graphic G1 does not include a graphic representing a lower part of the boom 4 including a part where a boom foot pin is attached and a part where an end of the boom cylinder 7 is attached. Furthermore, the graphic G1 does not include a graphic representing the boom cylinder 7. This is for increasing the visibility of the graphic representing an upper part of the boom 4, whose presentation to the operator is more needed during assistance with crane work, by simplifying the graphic G1 by omitting the display of a graphic representing a lower part of the boom 4, whose presentation to the operator is less needed during assistance with crane work. The graphic G1 may exclude the graphic representing the arm cylinder 8. That is, the graphic representing the aim cylinder 8 may be omitted.

The graphic G1 is displayed in such a manner as to move according to the actual movement of the boom 4. Specifically, the controller 30 changes the position and pose of the graphic G1 according as the boom angle θ1 detected by the boom angle sensor S1 changes, for example.

The graphic G2 is a graphic representing the arm 5 as viewed from the left side. According to the example illustrated in FIG. 7, the graphic G2 is a graphic representing the entirety of the arm 5, and includes a graphic representing the bucket cylinder 9. The graphic G2, however, may exclude the graphic representing the bucket cylinder 9. That is, the graphic representing the bucket cylinder 9 may be omitted.

The graphic G2 is displayed in such a manner as to move according to the actual movement of the arm 5. Specifically, the controller 30 changes the position and pose of the graphic G2 according as the boom angle θ1 detected by the boom angle sensor S1 changes and as the arm angle θ2 detected by the aim angle sensor S2 changes, for example.

The graphic G3 is a graphic representing the bucket 6 as viewed from the left side. According to the example illustrated in FIG. 7, the graphic G3 is a graphic representing the entirety of the bucket 6, and includes a graphic representing a bucket link. The graphic G3, however, may exclude the graphic representing a bucket link. That is, the graphic representing a bucket link may be omitted.

The graphic G3 is displayed in such a manner as to move according to the actual movement of the bucket 6. Specifically, the controller 30 changes the position and pose of the graphic G3 according as the boom angle θ1 detected by the boom angle sensor S1 changes, as the arm angle θ2 detected by the aim angle sensor S2 changes, and as the bucket angle θ3 detected by the bucket angle sensor S3 changes, for example.

Thus, the illustration image AM is created in such a manner as to include a graphic of a distal part of the attachment, which is a part of the attachment except for its base part (proximal part). The proximal part of the attachment means a part of the attachment closer to the upper swing structure 3, and includes a lower part of the boom 4, for example. The distal part of the attachment means a part of the attachment distant from the upper swing structure 3, and includes an upper part of the boom 4, the arm 5, and the bucket 6, for example. This is for increasing the visibility of the graphic representing the distal part of the attachment, whose presentation to the operator is more needed during assistance with crane work, by simplifying the illustration image AM by omitting the display of a graphic representing the proximal part of the attachment, whose presentation to the operator is less needed during assistance with crane work.

The graphic G70 represents a hook as viewed from the left side. According to the example illustrated in FIG. 7, the graphic G70 represents a hook attached to the bucket link in such a manner as to be accommodatable.

The graphic G71 represents a sling attached to a suspended load. According to the example illustrated in FIG. 7, the graphic G71 represents a sling wound around a water conduit pipe as a suspended load. The sling may be a wire.

The graphic G72 represents a suspended load. According to the example illustrated in FIG. 7, the graphic G72 represents a water conduit pipe as a suspended load hoisted by the shovel 100. The position, size, shape, etc., of the graphic G72 change according as the position, pose, etc., of the water conduit pipe change. The position, pose, etc., of the water conduit pipe are calculated based on the output of at least one of the object detector 70 and the image capturing device 80.

The graphic G73 represents an excavated trench. According to the example illustrated in FIG. 7, the graphic G73 represents a section of an excavated trench excavated by the shovel 100. The position, size, shape, etc., of the graphic G73 change according as the position, depth, etc., of the excavated trench change. The position, depth, etc., of the excavated trench are calculated based on the output of at least one of the object detector 70 and the image capturing device 80.

The graphic G74 represents an object installed in the excavated trench. According to the example illustrated in FIG. 7, the graphic G74 represents an existing water conduit pipe already installed in the excavated trench. The position, size, shape, etc., of the graphic G74 change according as the position, pose, etc., of the existing water conduit pipe change. The position, pose, etc., of the existing water conduit pipe are calculated based on the output of at least one of the object detector 70 and the image capturing device 80.

The graphic G80 represents the position of the far end of a suspended load hoisted by the shovel 100. According to the example illustrated in FIG. 7, the graphic G80 is a vertically extending dashed line and represents the position of the far end of the water conduit pipe hoisted by the shovel 100.

The graphic G81 represents the position of the near end of a suspended load hoisted by the shovel 100. According to the example illustrated in FIG. 7, the graphic G81 is a vertically extending dashed line and represents the position of the near end of the water conduit pipe hoisted by the shovel 100.

The graphic G82 represents the intended position of a suspended load that is the position of the far end of the suspended load when the suspended load is placed down on the ground. According to the example illustrated in FIG. 7, the graphic G82 is a vertically extending one-dot chain line and represents the intended position of the far end of the water conduit pipe hoisted by the shovel 100. The intended position of the far end of the water conduit pipe is set to be a position a predetermined distance short of (a position a predetermined distance closer to the shovel 100 than) the position of the near end of the adjacent existing water conduit pipe already installed in the excavated trench. This is for the water conduit pipe placed down on the bottom surface of the excavated trench being thereafter dragged over the bottom surface to have its far end inserted into the near end of the existing water conduit pipe to be connected to the existing water conduit pipe.

The graphic G83 represents the distance between the intended position and the current position of the far end of a suspended load. According to the example illustrated in FIG. 7, the graphic G83 is a double-headed arrow and represents the distance between the intended position and the current position of the far end of the water conduit pipe. The graphics G80 through G83 may be omitted for the clarification of the illustration image AM.

The operator of the shovel 100, who looks at the illustration image AM as illustrated in FIG. 7, can intuitively understand the size of the horizontal distance between the far end of the water conduit pipe in the air represented by the graphic G72 and the near end of the existing water conduit pipe represented by the graphic G74. Therefore, the shovel 100 can prevent contact between the water conduit pipe in the air and the existing water conduit pipe due to the operator's wrong operation. Furthermore, the operator of the shovel 100 can intuitively understand the size of the horizontal distance between the near end of the water conduit pipe in the air represented by the graphic G72 and the near end of the excavated trench represented by the graphic G73. Furthermore, the operator of the shovel 100 can intuitively understand the size of the vertical distance between the lower end of the water conduit pipe in the air represented by the graphic G72 and the bottom surface of the excavated trench represented by the graphic G73.

The illustration image AM, which represents the state of the excavation attachment AT and the water conduit pipe as seen from the left side according to the example illustrated in FIG. 7, may also represent the state of the excavation attachment AT and the water conduit pipe as seen from the right side or may also represent the state of the excavation attachment AT and the water conduit pipe as seen from above. Furthermore, at least two of the state as seen from the left side, the state as seen from the right side, and the state as seen from above may also be simultaneously displayed or may also be switchably displayed.

Furthermore, the controller 30, which displays the graphic G82 as the intended position of the far end of a suspended load according to the example illustrated in FIG. 7, may also display a graphic indicating the intended position of the near end of a suspended load. For example, the controller 30 may display the intended position of the near end of a suspended load based on the preset length of the suspended load or the length of the suspended load measured by at least one of the object detector 70 and the image capturing device 80 and the intended position of the far end of the suspended load.

Figure 8:
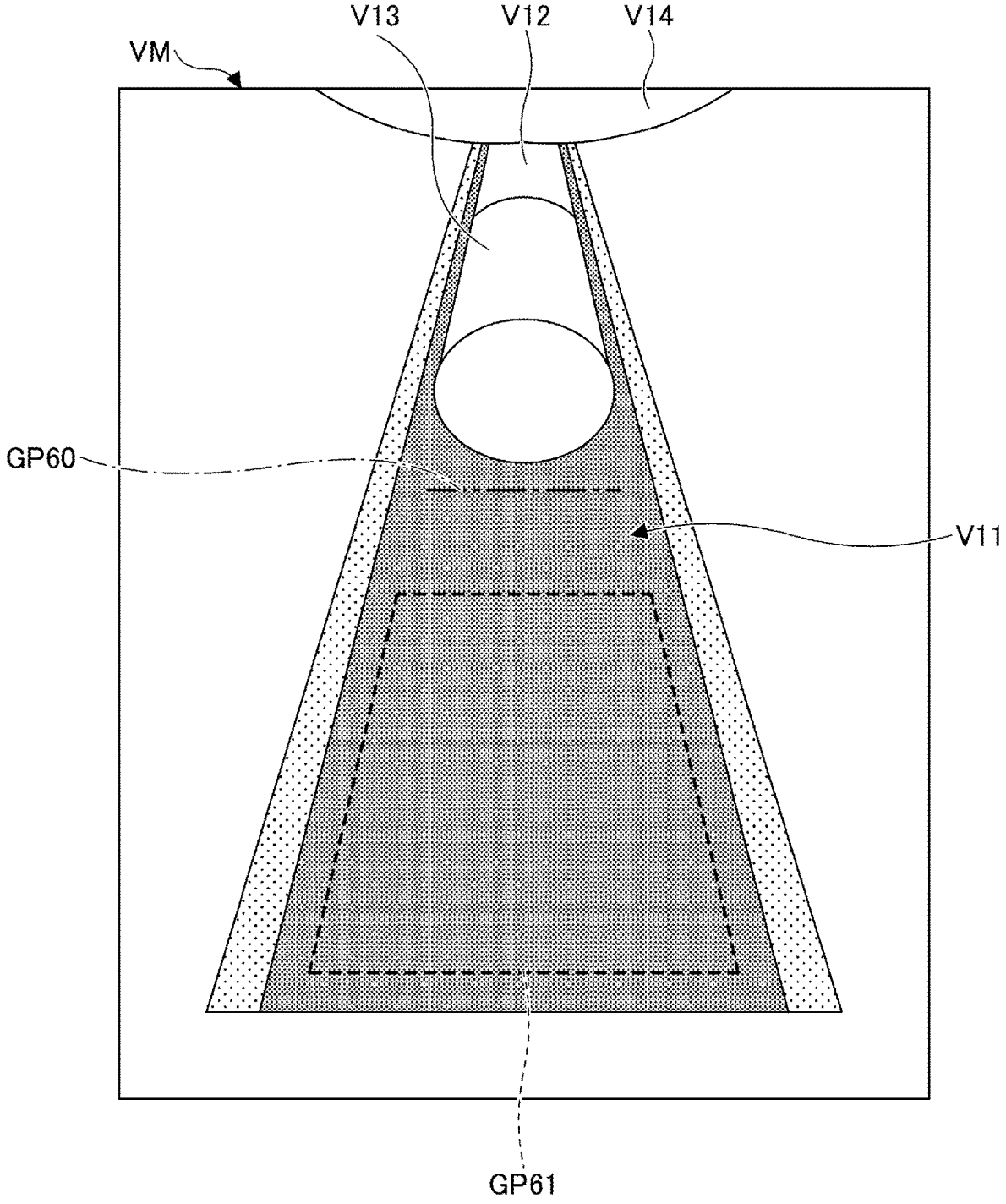
FIG. 8 is a diagram illustrating an example of the image displayed during crane work.

Next, an example of guidance displayed during crane work is described with reference to FIG. 8. FIG. 8 illustrates an example of an image displayed in the first image display area 41*n*1 of the image display area 41*n* of the display device 40 during crane work.

The image illustrated in FIG. 8 mainly includes the front image VM captured by the front camera 80F and a graphic GP60 and a graphic GP61 as AR images superimposed and displayed over the front image VM.

The front image VM illustrated in FIG. 8 includes an image of an excavated trench positioned in front of the shovel 100. Specifically, the front image VM includes images V11 through V14. The image V11 is an image of the excavated trench. The image V12 and the image V13 are images of existing water conduit pipes already installed in the excavated trench. The image V14 is an image of a water conduit pipe hoisted by the shovel 100.

The graphic GP60 is a marker representing the intended position of the far end of a suspended load hoisted by the shovel 100. The graphic GP61 is a marker representing the shape of a projection when the outer shape of a suspended load hoisted by the shovel 100 is projected onto the ground.

According to the example illustrated in FIG. 8, the graphic GP60 is a translucent one-dot chain line marker to represent the intended position of the far end of the water conduit pipe hoisted by the shovel 100 and is displayed in such a manner as to extend over the entire width of the excavated trench. The graphic GP61 is a translucent dashed-line marker to represent the shape of a projection when the outer shape of the water conduit pipe hoisted by the shovel 100 is projected onto the bottom surface of the excavated trench. At least one of the graphic GP60 and the graphic GP61 may be a translucent solid-line marker.

When a suspended load is lowered to approach the bottom surface of an excavated trench, an image of a feature such as the bottom surface of the excavated trench, an existing water conduit pipe, or the like is hidden by an image of the suspended load to become invisible. Therefore, the controller 30 may generate an image by removing the image of the suspended load from a front image through image processing and superimpose and display markers such as the graphic GP60 and the graphic GP61 over the generated image.

Furthermore, the controller 30, which displays the graphic GP60 as a marker representing the intended position of the far end of a suspended load hoisted by the shovel 100 according to the example illustrated in FIG. 8, may also display a graphic as a marker that represents the intended position of the near end of a suspended load. For example, the controller 30 may display a marker that represents the intended position of the near end of a suspended load based on the preset length of the suspended load or the length of the suspended load measured by at least one of the object detector 70 and the image capturing device 80 and the intended position of the far end of the suspended load.

The operator of the shovel 100, who looks at the front image VM as illustrated in FIG. 8, can intuitively understand the positional relationship between the water conduit pipe hoisted by the shovel 100 and the existing water conduit pipes. Therefore, the shovel 100 can prevent contact between the water conduit pipe in the air and the existing water conduit pipes due to the operator's wrong operation. Furthermore, the operator can intuitively understand that the water conduit pipe hoisted by the shovel 100 is immediately above the excavated trench and that the horizontal distance between the current position and the intended position of its far end is not zero. That is, the operator can intuitively understand that the far end of the water conduit pipe in the air needs to be moved farther (needs to be moved closer to the existing water conduit pipes already installed in the excavated trench).

The image illustrated in FIG. 8 may be displayed on a display device attached to an assist device such as a portable terminal outside the shovel 100 used by a remote control operator, instead of the display device 40 installed in the cabin 10 of the shovel 100. The image presenting part 30B may display each of the graphic GP60 and the graphic GP61 on the bottom surface of the excavated trench using projection mapping techniques.

The image illustrated in FIG. 7 and the image illustrated in FIG. 8 may be switchably displayed. For example, the controller 30 may switch the images when a predetermined button operation is performed or may switch the images each time a predetermined period of time passes.

Figure 9:
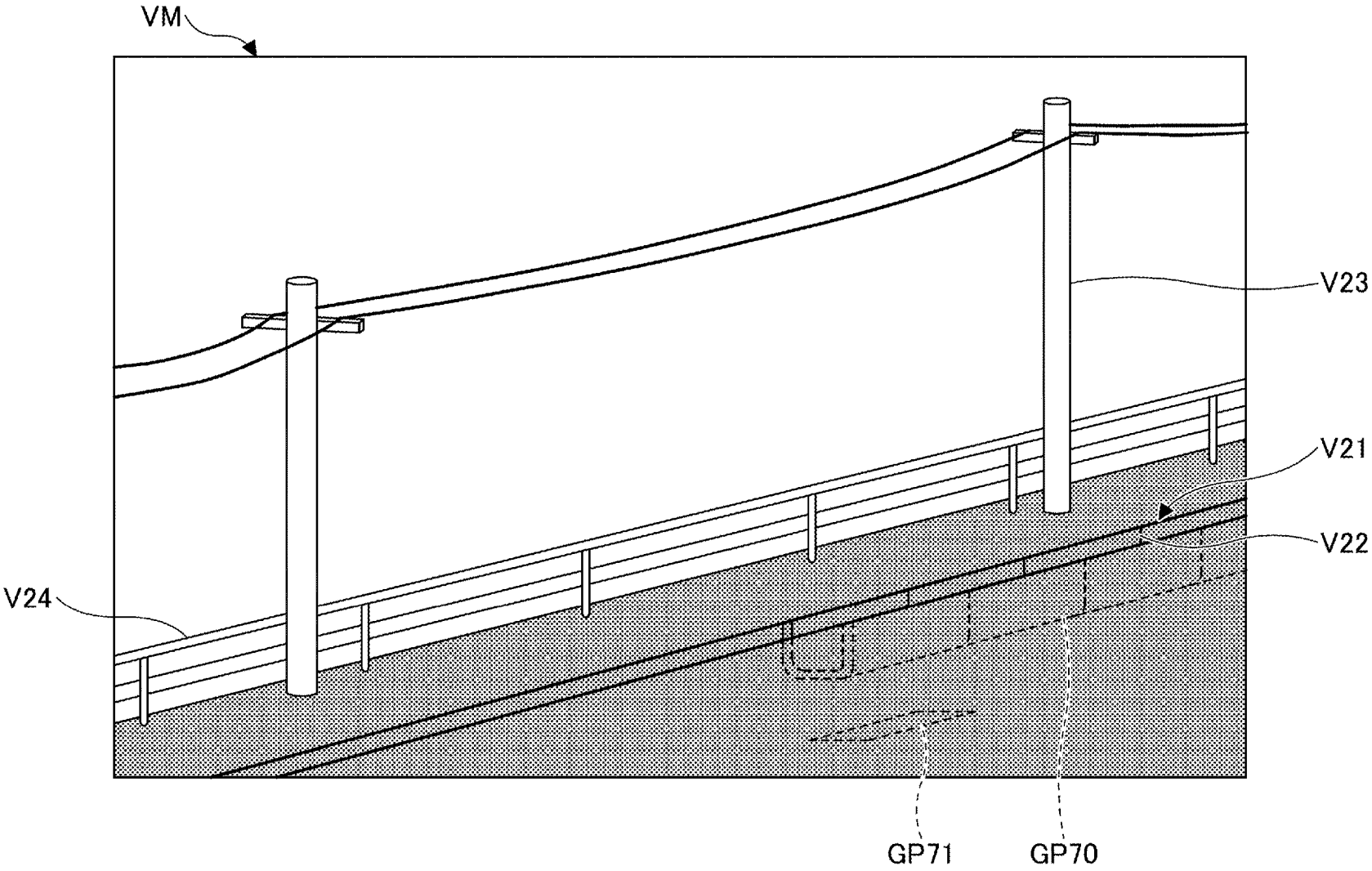
FIG. 9 is a diagram illustrating an example of the image displayed during crane work.

Next, another example of the guidance displayed during crane work is described with reference to FIG. 9. FIG. 9 illustrates another example of the image displayed in the first image display area 41*n*1 of the image display area 41*n* of the display device 40 during crane work. For clarification, the graphical representation of an image of the excavation attachment AT and an image of a suspended load (U-shaped gutter) hoisted by the excavation attachment AT is omitted in FIG. 9.

The image illustrated in FIG. 9 mainly includes the front image VM captured by the front camera 80F and a graphic GP70 and a graphic GP71 as AR images superimposed and displayed over the front image VM. The front image VM may be a three-dimensional computer-generated graphic generated based on design data input to the controller 30 in advance.

The front image VM illustrated in FIG. 9 includes an image of an excavated trench positioned in front of the shovel 100. Specifically, the front image VM includes images V21 through V24. The image V21 is an image of an excavated trench in which concrete U-shaped gutters are installed. The image V22 is an image of U-shaped gutters already installed (hereinafter "existing U-shaped gutters") in the excavated trench. The image V23 is an image of a utility pole. The image V24 is an image of a guardrail.

The graphic GP70 is a translucent dashed-line marker representing the shape of the existing U-shaped gutters. The graphic GP71 is a translucent dashed-line marker representing the shape of a projection when the outer shape of a U-shaped gutter hoisted by the shovel 100 is projected onto the ground.

While an image captured by the front camera 80F is employed as the image illustrated in FIG. 9, an overhead view image generated based on images captured by the image capturing device 80 may also be employed.

Furthermore, the controller 30 may superimpose and display a graphic serving as the intended position of the far end of a suspended load or a graphic serving as the intended position of the near end of a suspended load over the front image VM.

The operator of the shovel 100, who looks at the front image VM as illustrated in FIG. 9, can intuitively understand the positional relationship between the U-shaped gutter hoisted by the shovel 100 and the existing U-shaped gutters. Therefore, the operator can move the currently hoisted U-shaped gutter to a position close to the existing U-shaped gutters and appropriately lower the currently hoisted U-shaped gutter into the excavated trench. That is, the shovel 100 can prevent contact between the U-shaped gutter in the air and the existing U-shaped gutters due to the operator's wrong operation.

According to the examples of FIGS. 7 through 9, the controller 30 may detect the position, shape (dimensions), or type of an installed object installed by crane work with a surrounding area monitor and display guidance based on the result of this detection. Specifically, the controller 30 obtains the shape of an installed object and the shape of a trench around the installed object with a surrounding area monitor and distinguishes between the installed object and the trench. Then, the controller 30 calculates, as a reference point, the position of the installed object in a plane in which the installed object is installed. At this point, the graphics G82, GP60 and GP70 may be displayed at certain distances from the reference point in a plane in which a suspended load is desired to be installed.

Furthermore, the controller 30 may detect the position, shape (dimensions), or type of an object lifted by the attachment and display guidance based on the result of the detection. For example, giving an explanation based on the example of FIG. 8, a clay pipe (suspended load) lifted by the attachment and a clay pipe as an installed object installed by crane work are detected by a surrounding area monitor. At this point, the positions, shapes, and types of the suspended load and the installed object are detected, and guidance such as GP60 and GP61 are displayed based on the result of this detection. For example, GP60 is displayed based on the width of the installed object. Furthermore, GP61 is displayed based on the width and the length of the suspended load. The detection may also be performed based on a shape or a type (dimensions, position).

Furthermore, while examples of guidance in loading work or crane work are described in the above-described examples, guidance may also be applied to excavation work or compaction work. For example, in the case of excavation work, the controller 30 may obtain, as an excavation start position serving as a reference point, any position on a ground surface a predetermined distance away from an object (such as a wall face, a tree, a pylon, a finishing stake, a trench, or a change in the ground) with a surrounding area monitor, and display a line predetermined distance by predetermined distance from this reference point. Furthermore, for example, in the case of compaction work, the controller 30 may obtain, as an intended compaction area serving as a reference point, any position on a ground surface a predetermined distance away from an object (such as a wall face, a tree, a pylon, a finishing stake, or a change in the ground) from the output information of a surrounding area monitor or information on the pose of the attachment, and display a line predetermined distance by predetermined distance from this reference point. At this point, guidance is provided in such a manner as to make it possible to understand the distance from the reference point in a swing radius direction. Then, it is displayed how far the current position of the attachment is located relative to the displayed lines. Thus, the controller 30 detects an object present in a worksite or a change in the ground shape as an object and displays guidance based on the detected object. Therefore, the operator of the shovel 100 can intuitively understand the distance to the excavation start position or the intended compaction area even in excavation work or compaction work.

As described above, the shovel 100 that is an example of a work machine according to an embodiment of the present invention includes the lower traveling structure 1, the upper swing structure 3 swingably mounted on the lower traveling structure 1, the excavation attachment AT serving as an attachment attached to the upper swing structure 3, a surrounding area monitor, and the display device 40. The display device 40 is configured to display guidance with respect to an object detected by the surrounding area monitor. The object detected by the surrounding area monitor is, for example, the dump truck 60 as illustrated in FIG. 4A, an existing water conduit pipe installed in an excavated trench as illustrated in FIG. 7, a U-shaped gutter installed in an excavated trench as illustrated in FIG. 9 or the like. Furthermore, the object detected by the surrounding area monitor may also be a water conduit pipe such as a clay pipe or a hume pipe or a U-shaped gutter as a suspended load, earth scooped into the bucket by excavation, or the like. Furthermore, the display device 40 may also be configured to display guidance corresponding to the height of the object. Furthermore, the display device 40 may also be configured to display guidance in a swing radius direction relative to the object. According to this configuration, the shovel 100 can more effectively assist the operator in operating the shovel 100. For example, the shovel 100 can reduce the risk of the operator bringing the bucket 6 into contact with the bed 61 of the dump truck 60. This is because it is possible to reduce difficulty in understanding the distance between the bucket 6 and the front panel 63 in the longitudinal direction of the bed 61 as seen from inside the cabin 10 through the windshield FG. Furthermore, by making it possible for the operator to easily monitor the relative positional relationship between the bucket 6 and the bed 61 of the dump truck 60 during loading work, the shovel 100 can reduce the fatigue of the operator due to the continuance of a careful operation for a long time. Furthermore, for the same reason, the shovel 100 can prevent a decrease in work efficiency in the case of dumping an excavated object near the front panel 63 compared with the case of dumping an excavated object in the center of the bed 61 of the dump truck 60. For example, the shovel 100 can reduce the risk of the operator bringing a suspended load into contact with an existing object. This is because it is possible to reduce difficulty in understanding the distance between the suspended load and the existing object as seen from inside the cabin 10 through the windshield FG. Furthermore, by making it possible for the operator to easily monitor the relative positional relationship between the suspended load and the existing object during crane work, the shovel 100 can reduce the fatigue of the operator due to the continuance of a careful operation for a long time. Examples of suspended loads include a water conduit pipe such as a clay pipe or a hume pipe and a U-shaped gutter. Example of existing objects include an existing water conduit pipe or an existing U-shaped gutter already installed in an excavated trench.

The front area image may be, for example, an image including a marker whose display position changes according as the attachment moves or an image including a marker whose display position does not change even when the attachment moves. Specifically, examples of markers whose display position changes according as the attachment moves include the graphics GP20 through GP22 in FIG. 6B. Furthermore, examples of markers whose display position does not change even when the attachment moves include the graphics GP10 through GP14 in FIG. 6A.

Furthermore, the front area image may include, for example, a marker whose display position changes according as the horizontal position of a predetermined part of the attachment changes but does not change according as the vertical position of the predetermined part changes. Specifically, examples of markers whose display position changes according as the horizontal position of a predetermined part of the attachment changes but does not change according as the vertical position of the predetermined part changes include the graphics GP20 through GP22 in FIG. 6B.

Furthermore, the front area image may be, for example, an image constructed in such a manner as to enable the operator to recognize gradual changes in the relative positional relationship between an object positioned in front of the upper swing structure 3 and the attachment or an object lifted by the attachment. Specifically, the front area image may include the graphics G51 through G54 that represent a part of the excavation attachment AT on its distal end side, which are displayed in such a manner as to change at least one of color, luminance, color density, etc., according to the actual movement of the excavation attachment AT as illustrated in FIG. 5B. The graphics G51 through G54 are typically spaced at predetermined intervals. In this case, the front area image may be constructed in such a manner as to enable the operator to recognize the number of steps of the change. FIG. 5B illustrates that the number of steps is four. Furthermore, the display and non-display of the respective outlines of the graphics G51 through G54, which are constantly displayed in the illustration image AM according to the example illustrated in FIG. 5B, may be switched according to the movement of the excavation attachment AT.

Furthermore, the front area image may include the graphic G1, which represents an upper part of the boom 4 including a part where an arm foot pin is attached as illustrated in FIG. 5A. The graphic G1 may either include a graphic representing the arm cylinder 8 or exclude a graphic representing the arm cylinder 8. The graphic G1 does not include a graphic representing a lower part of the boom 4 including a part where a boom foot pin is attached and a part where an end of the boom cylinder 7 is attached. Furthermore, the graphic G1 does not include a graphic representing the boom cylinder 7. This is for increasing the visibility of the graphic representing an upper part of the boom 4, whose presentation to the operator is more needed during assistance with loading work, crane work or the like, by simplifying the graphic G1 by omitting the display of a graphic representing a lower part of the boom 4, whose presentation to the operator is less needed during assistance with loading work, crane work or the like. Thus, the front area image may be constructed in such a manner as to exclude an image of a lower part of the attachment while including an image of an upper part of the attachment.

The display device 40 is typically configured to display a graphic that represents the relative positional relationship between an object positioned in an area surrounding the work machine and the excavation attachment AT or an object lifted by the excavation attachment AT with respect to a swing radius direction.

Examples of objects positioned in an area surrounding the work machine include an installed object installed by the shovel 100 as a work machine. Examples of installed objects include water conduit pipes such as clay pipes and hume pipes and U-shaped gutters. Furthermore, the installed object may also be a mound of earth formed by excavation. In this case, the graphic may be constructed in such a manner as to represent the relative positional relationship between a position regarding the installed objected and an object lifted by the excavation attachment AT with respect to a swing radius direction.

Examples of graphics that represent the relative positional relationship between the dump truck 60 and the excavation attachment AT include the graphics G1 through G4 illustrated in FIG. 5A, the graphics G5 and G6 illustrated in FIG. 5B, the graphic G3A illustrated in FIG. 5C, the graphics GP10 through GP14 illustrated in FIG. 6A, the graphics GP20 through GP22 illustrated in FIG. 6B, the graphics GP30 through GP34 illustrated in FIG. 6C, the graphics GP40 through GP42 illustrated in FIG. 6D, and the graphics GP50 and GP51 illustrated in FIG. 6E. Examples of graphics that represent the relative positional relationship between an existing object and an object lifted by the excavation attachment AT include the graphics G1 through G3, the graphics G70 through G74 and the graphics G80 through G83 illustrated in FIG. 7, the graphics GP60 and GP61 illustrated in FIG. 8, and the graphics GP70 and GP71 illustrated in FIG. 9. According to this configuration, the operator of the shovel 100, who looks at graphics displayed on the display device 40, can intuitively understand the relative positional relationship between an object positioned in front of the upper swing structure 3 and the excavation attachment AT or an object lifted by the excavation attachment AT.

A graphic that represents the relative positional relationship between the dump truck 60 and the excavation attachment AT may be displayed in such a manner as to correspond to each of the current state of the bucket 6 and the state of the bucket 6 when the bucket 6 is opened. For example, the graphic G3 illustrated in FIG. 5C is displayed in such a manner as to correspond to the current state of the bucket 6, and the graphic G3A illustrated in FIG. 5C is displayed in such a manner as to correspond to the state of the bucket 6 when the bucket 6 is opened. According to this configuration, the operator of the shovel 100, who looks at graphics displayed on the display device 40, can intuitively understand the relative positional relationship between the bucket 6 and the dump truck 60 when the bucket 6 is opened before the bucket 6 is opened, for example.

The shovel 100 may also include the controller 30 serving as a control device to restrict the movement of the excavation attachment AT. For example, the controller 30 may be configured to stop the movement of the excavation attachment AT in response to determining that there is a possibility of contact between an object positioned in front of the upper swing structure 3 and the excavation attachment AT or an object lifted by the excavation attachment AT. According to this configuration, the controller 30 can effectively prevent contact between the dump truck 60 and the excavation attachment AT.

An embodiment of the present invention is described in detail above. The present invention, however, is not limited to the above-described embodiment. Various variations, substitutions, or the like may be applied to the above-described embodiment without departing from the scope of the present invention. Furthermore, separately described features may be combined to the extent that no technical contradiction is caused.

For example, the shovel 100 may simultaneously display the illustration image AM illustrated in FIG. 5A, 5B or 5C and the AR image illustrated in FIG. 6A, 6B, 6C, 6D or 6E. The shovel 100 may also switch and alternatively display at least two of the illustration images AM illustrated in FIGS. 5A, 5B and 5C, may also switch and alternatively display the AR images illustrated in FIGS. 6A, 6B and 6E, and may also switch and alternatively display the AR images illustrated in FIGS. 6C, 6D and 6E. Likewise, the shovel 100 may simultaneously display the illustration image AM illustrated in FIG. 7 and the AR image illustrated in FIG. 8. The shovel 100 may also switch and alternatively display the illustration image AM illustrated in FIG. 7 and the AR image illustrated in FIG. 8.

Figure 10:
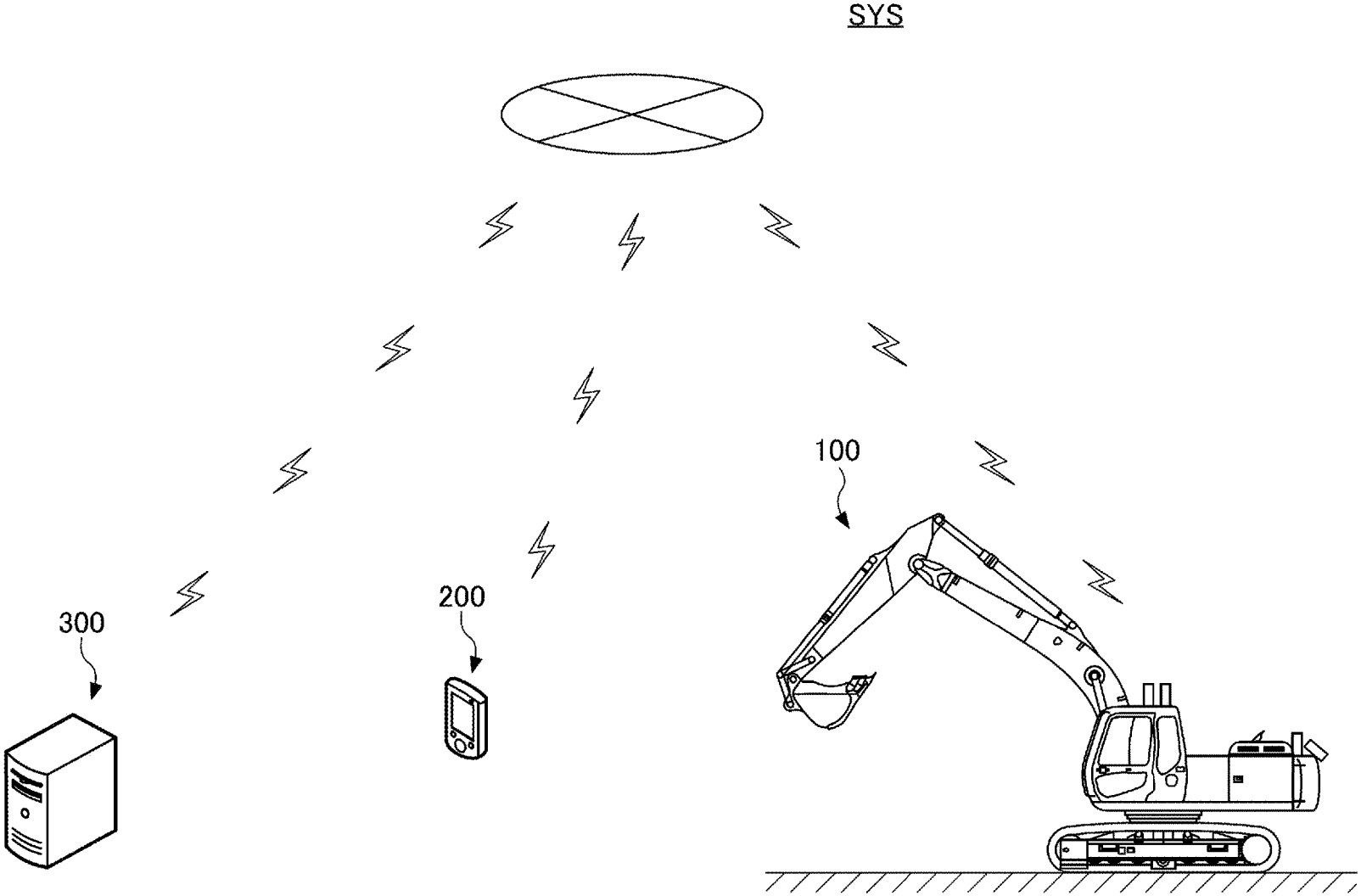
FIG. 10 is a schematic diagram illustrating an example configuration of a shovel management system.

Information obtained by the shovel 100 may be shared with a related party through a shovel management system SYS as illustrated in FIG. 10. Examples of related parties include the operator of the shovel 100, a worker at a construction site, an operator of another shovel, and a manager of the shovel 100. FIG. 10 is a schematic diagram illustrating an example configuration of the management system SYS of the shovel 100. The management system SYS is a system that manages one or more shovels 100. According to this embodiment, the management system SYS is constituted mainly of the shovel 100, an assist device 200, and a management apparatus 300. Each of the shovel 100, the assist device 200, and the management apparatus 300 constituting the management system SYS may be one or more in number. According to the example illustrated in FIG. 10, the management system SYS includes the single shovel 100, the single assist device 200, and the single management apparatus 300.

Figure 12:
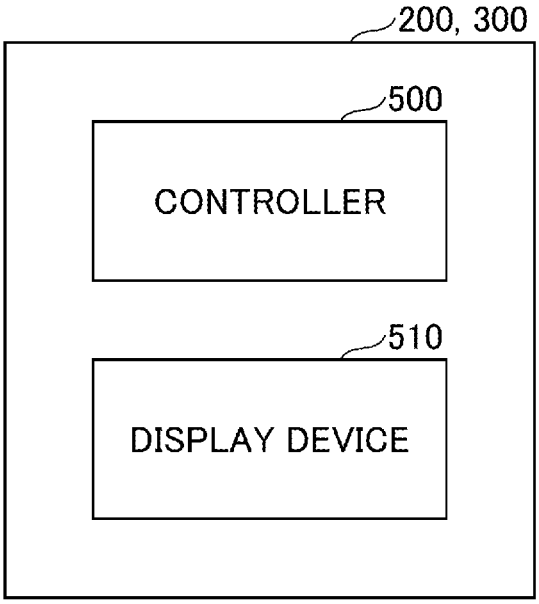
FIG. 12 is a schematic diagram illustrating a configuration of each of an assist device and a management apparatus according to the embodiment.

FIG. 12 is a schematic diagram illustrating a configuration of each of the assist device 200 and the management apparatus 300. Referring to FIG. 12, each of the assist device 200 and the management apparatus 300 includes a controller 500 and a display device 510. Like the controller 30, the controller 500 is constituted of a computer including a CPU, a volatile storage, and a non-volatile storage. The controller 500 reads programs from the non-volatile storage and executes the programs to implement various functions. The display device 510 includes a display.

The assist device 200 is connected to the management apparatus 300 through a predetermined communication line in such a manner as to be able to communicate with the management apparatus 300. The assist device 200 may also be connected to the shovel 100 through a predetermined communication line in such a manner as to be able to communicate with the shovel 100. Examples of predetermined communication lines may include a mobile communication network including a base station as a terminal end, a satellite communication network using a communications satellite, a short-range radio communications network based on a communications standard such as Bluetooth (registered trademark) or Wi-Fi. The assist device 200 is, for example, a user terminal used by a user such as an operator, the owner, or the like of the shovel 100, a worker, a supervisor, or the like at a worksite, a manager, a worker, or the like of the management apparatus 300, or the like (hereinafter "assist device user"). Examples of the assist device 200 include portable terminals such as a laptop computer terminal, a tablet terminal, and a smartphone. Furthermore, the assist device 200 may also be, for example, a stationary terminal apparatus such as a desktop computer terminal.

The management apparatus 300 is connected to the shovel 100 and the assist device 200 through a predetermined communication line in such a manner as to be able to communicate with the shovel 100 and the assist device 200. The management apparatus 300 is, for example, a cloud server installed in a management center outside a worksite. The management apparatus 300 may also be, for example, an edge server installed in a makeshift office or the like within a worksite or in a communications facility relatively close to a worksite (for example, a base station or a shelter). Furthermore, the management apparatus 300 may also be, for example, a terminal apparatus used in a worksite. Examples of terminal apparatuses may include portable terminals such as a laptop computer terminal, a tablet terminal, and a smartphone and stationary terminal apparatuses such as a desktop computer terminal.

At least one of the assist device 200 and the management apparatus 300 may be provided with a monitor and an operating device for remote control. In this case, the operator may operate the shovel 100 using the operating device for remote control. The operating device for remote control is connected to the controller 30 through a radio communications network such a wireless LAN, for example. While the exchange of information between the shovel 100 and the assist device 200 is described below, the following description is similarly applied to the exchange of information between the shovel 100 and the management apparatus 300.

Furthermore, an information image having the same contents as those displayable on the display device 40 in the cabin 10 (for example, image information showing a situation in an area surrounding the shovel 100, various settings screens, the front image VM, the illustration image AM, or a screen corresponding to an AR image) may be displayed on the display device 510 of the assist device 200 or the management apparatus 300. The image information showing a situation in an area surrounding the shovel 100 may be generated based on an image captured by the image capturing device 80, or the like. This enables the assist device user or a management apparatus user to remotely control the shovel 100 and provide various settings with respect to the shovel 100 while checking a situation in an area surrounding the shovel 100.

According to the management system SYS of the shovel 100 as described above, the controller 30 of the shovel 100 may transmit the illustration image AM, an AR image or the like as a front area image created by the image presenting part 30B to the assist device 200. In this case, the controller 30 may transmit, for example, an image captured by the image capturing device 80 serving as a surrounding area monitor (a space recognition device) or the like to the assist device 200. Furthermore, the controller 30 may transmit information on at least one of data on the work details of the shovel 100, data on the pose of the shovel 100, data on the pose of the excavation attachment, etc., to the assist device 200, in order to enable a related party using the assist device 200 to obtain information on a worksite. The data on the work details of the shovel 100 is at least one of, for example, the number of times of loading that is the number of times a dumping motion is performed, information on an excavated object such as earth loaded onto the bed 61 of the dump truck 60, the type of the dump truck 60 with respect to loading work, information on the position of the shovel 100 when loading work is performed, information on a work environment, information on the operation of the shovel 100 during loading work, etc. The information on an excavated object is at least one of, for example, the weight, type, etc., of an excavated object excavated by each excavating operation, the weight, type, etc., of an excavated object loaded into the dump truck 60, the weight, type, etc., of an excavated objected loaded by a day's loading work, etc. The information on a work environment is, for example, information on the inclination of the ground in an area surrounding the shovel 100, information on the weather around a work site, or the like. The information on the operation of the shovel 100 is at least one of, for example, the output of an operating pressure sensor 29, the output of a cylinder pressure sensor, etc.

At least one of the position obtaining part 30A, the image presenting part 30B, and the operation assistance part 30C, which are functional elements of the controller 30, may be implemented as a functional element of the control device of the assist device 200.

Thus, the assist device 200 according to the embodiment of the present invention is configured to assist with work performed by the shovel 100 including the lower traveling structure 1, the upper swing structure 3 swingably mounted on the lower traveling structure 1, and the excavation attachment AT attached to the upper swing structure 3. The assist device 200 includes a display device that displays a front area image representing the relative positional relationship between the dump truck 60 positioned in front of the upper swing structure 3 and the excavation attachment AT. According to this configuration, the assist device 200 can present information on an area in front of the upper swing structure 3 to a related party.

When the shovel 100 is remotely controlled, the distance between the bucket 6 and the front panel 63 in the longitudinal direction of the bed 61 that can be seen by the operator through an image displayed on the display device 510 of the assist device 200 becomes more difficult to understand than in the case of seeing the distance through the windshield FG of the cabin 10. By displaying the front area image as described above, the assist device 200 can effectively assist the operator in operating the shovel 100 the same as in the case of performing operation in the cabin 10.

Furthermore, according to the above-described embodiment, a hydraulic operation system including hydraulic pilot circuit is disclosed. For example, in a hydraulic pilot circuit associated with the boom operating lever 26A, hydraulic oil supplied from the pilot pump 15 to the boom operating lever 26A is supplied to a pilot port of the control valve 154 with a pressure commensurate with the degree of opening of a remote control valve operated by the tilt of the boom operating lever 26A in an opening direction. In a hydraulic pilot circuit associated with the bucket operating lever 26B, hydraulic oil supplied from the pilot pump 15 to the bucket operating lever 26B is supplied to a pilot port of the control valve 158 with a pressure commensurate with the degree of opening of a remote control valve operated by the tilt of the bucket operating lever 26B in an opening direction.

Instead of such a hydraulic operation system including a hydraulic pilot circuit, however, an electric operation system with an electric pilot circuit may be adopted. In this case, the amount of lever operation of an electric operating lever in the electric operation system is input to the controller 30 as an electrical signal, for example. Furthermore, a solenoid valve is placed between the pilot pump 15 and a pilot port of each control valve. The solenoid valve is configured to operate in response to an electrical signal from the controller 30. According to this configuration, when a manual operation using the electric operating lever is performed, the controller 30 can move each control valve by increasing or decreasing a pilot pressure by controlling the solenoid valve with an electrical signal commensurate with the amount of lever operation. Each control valve may be constituted of a solenoid spool valve. In this case, the solenoid spool valve electromagnetically operates in response to an electrical signal from the controller 30 commensurate with the amount of lever operation of the electric operating lever.

Figure 11:
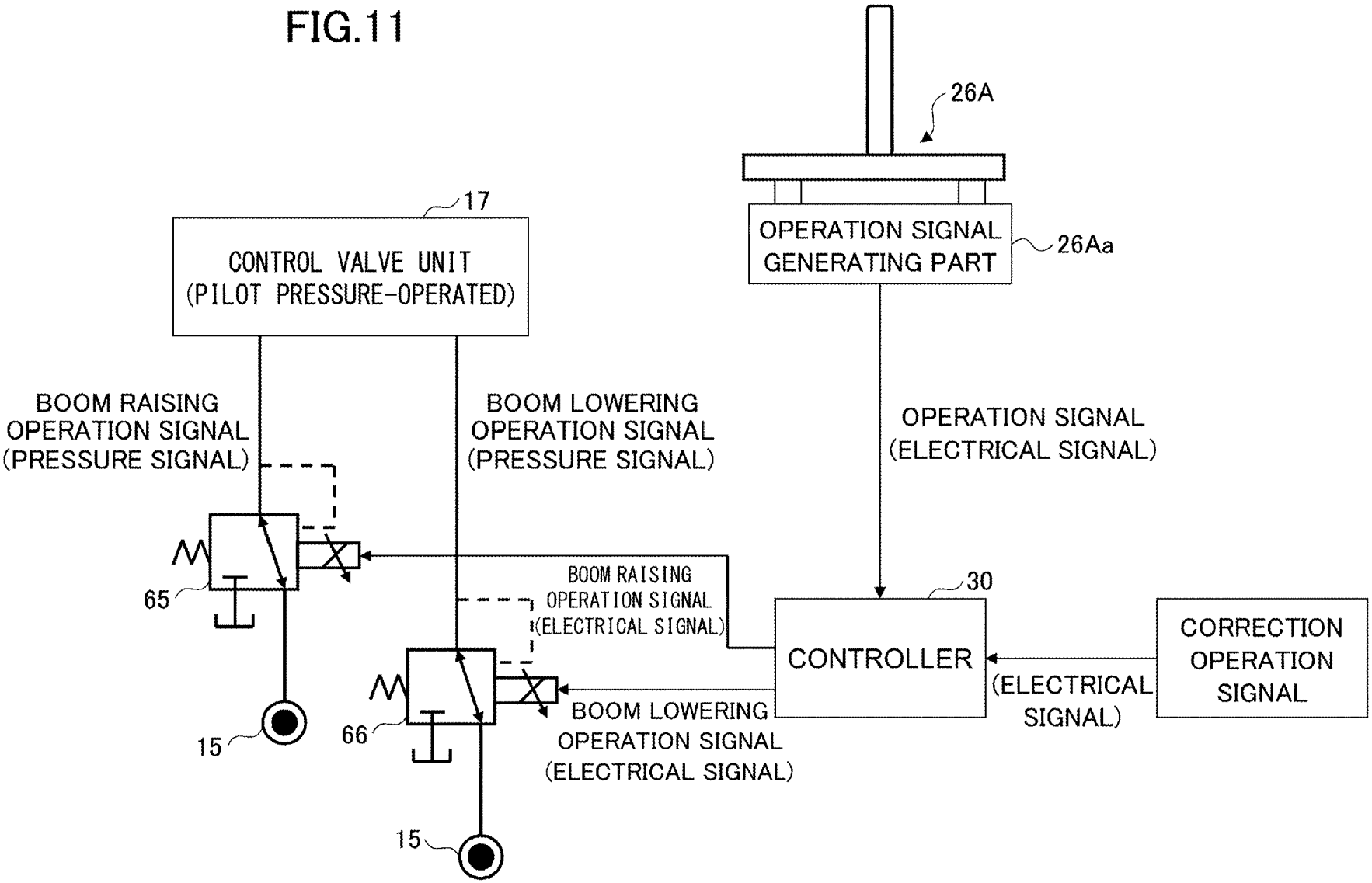
FIG. 11 is a diagram illustrating an example configuration of an electric operation system.

When the electric operation system including an electric operating lever is adopted, the controller 30 can more easily execute the machine guidance function, the machine control function, etc., than in the case where the hydraulic operation system including a hydraulic operating lever is adopted. FIG. 11 illustrates an example configuration of the electric operation system. Specifically, the electric operation system of FIG. 11 is an example of a boom operation system for raising and lowering the boom 4, and is constituted mainly of a pilot pressure-operated control valve unit 17, the boom operating lever 26A serving as an electric operating lever, the controller 30, a solenoid valve 65 for boom raising operation, and a solenoid valve 66 for boom lowering operation. The electric operation system of FIG. 11 may also be likewise applied to a travel operation system for causing the lower traveling structure 1 to travel, a swing operation system for swinging the upper swing structure 3, an arm operation system for opening and closing the aim 5, a bucket operation system for opening and closing the bucket 6, etc.

The pilot pressure-operated control valve unit 17 includes the control valve 150 serving as a straight travel valve, the control valve 151 associated with the left travel hydraulic motor 2ML, the control valve 152 associated with the right travel hydraulic motor 2MR, the control valve 153 and the control valve 154 associated with the boom cylinder 7, the control valve 155 and the control valve 156 associated with the arm cylinder 8, the control valve 157 associated with the swing hydraulic motor 2A, the control valve 158 associated with the bucket cylinder 9, etc., as illustrated in FIG. 2. The solenoid valve 65 is configured to be able to adjust the pressure of hydraulic oil in conduits connecting the pilot pump 15 and the respective boom-raising-side pilot ports of the control valve 153 and the control valve 154. The solenoid valve 66 is configured to be able to adjust the pressure of hydraulic oil in conduits connecting the pilot pump 15 and the respective boom-lowering-side pilot ports of the control valve 153 and the control valve 154.

When a manual operation is performed, the controller 30 generates a boom raising operation signal (electrical signal) or a boom lowering operation signal (electrical signal) in accordance with an operation signal (electrical signal) output by an operation signal generating part 26Aa of the boom operating lever 26A. The operation signal output by the operation signal generating part 26Aa of the boom operating lever 26A is an electrical signal that changes in accordance with the amount of operation and the direction of operation of the boom operating lever 26A.

Specifically, when the boom operating lever 26A is operated in the boom raising direction, the controller 30 outputs a boom raising operation signal (electrical signal) commensurate with the amount of lever operation to the solenoid valve 65. The solenoid valve 65 operates according to the boom raising operation signal (electrical signal) to control a pilot pressure serving as a boom raising operation signal (pressure signal) to be applied to the boom-raising-side pilot port of each of the control valve 153 and the control valve 154. Likewise, when the boom operating lever 26A is operated in the boom lowering direction, the controller 30 outputs a boom lowering operation signal (electrical signal) commensurate with the amount of lever operation to the solenoid valve 66. The solenoid valve 66 operates according to the boom lowering operation signal (electrical signal) to control a pilot pressure serving as a boom lowering operation signal (pressure signal) to be applied to the boom-lowering-side pilot port of each of the control valve 153 and the control valve 154.

In the case of executing an autonomous control function, the controller 30, for example, generates the boom raising operation signal (electrical signal) or the lowering operation signal (electrical signal) in accordance with a correction operation signal (electrical signal) instead of responding to the operation signal (electrical signal) output by the operation signal generating part 26Aa of the boom operating lever 26A. The correction operation signal may be an electrical signal generated by the controller 30 or an electrical signal generated by a control device other than the controller 30.

Furthermore, the shovel 100, which is configured in such a manner as to enable the operator to ride in the cabin 10 according to the above-described embodiment, may also be a shovel of a remote control type. In this case, the operator can remotely operate the shovel 100 using an operating device and a communications device installed in a remote control room outside a worksite, for example. In this case, the controller 30 may be installed in the remote control room. That is, the controller 30 installed in the remote control room and the shovel 100 may constitute a system for a shovel.

What is claimed is:

1. A work machine comprising:

a lower traveling structure;

an upper swing structure swingably mounted on the lower traveling structure;

an attachment attached to the upper swing structure;

a surrounding area monitor; and a display, wherein the display is configured to display a first object detected by the surrounding area monitor and guidance with respect to the first object, said first object and the guidance being displayed separately from each other, and wherein the guidance includes a graphic indicating a position of the attachment in a swing radius direction of the attachment relative to the first object, or a position of a second object that is lifted by the attachment in a swing radius direction of the second object relative to the first object, wherein the guidance includes a plurality of markers arranged in the swing radius direction of the attachment and indicates, by highlighting a marker corresponding to a position of the attachment, the position of the attachment relative to the first object, or the position of a second object that is lifted by the attachment relative to the first object, said plurality of markers indicating a position in the swing radius direction of the attachment.

2. The work machine as claimed in claim 1, wherein the display is configured to display the guidance corresponding to a height of the object.

3. The work machine as claimed in claim 1, wherein a reference point is set based on the object, and the display is configured to display the guidance with respect to a distance from the reference point in a swing radius direction.

4. The work machine as claimed in claim 1, wherein the display is configured to display a graphic as the guidance, the graphic representing a position of the attachment or an object lifted by the attachment with respect to a swing radius direction, relative to the object positioned in an area surrounding the work machine.

5. The work machine as claimed in claim 4, wherein the object lifted by the attachment includes earth scooped into a bucket or a suspended load.

6. The work machine as claimed in claim 5, wherein the object positioned in the area surrounding the work machine is a dump truck, and the graphic is displayed in such a manner as to correspond to each of a current state of the bucket and a state of the bucket when the bucket is opened.

7. The work machine as claimed in claim 4, wherein the object positioned in the area surrounding the work machine is an installed object installed by the work machine, and the graphic is constructed in such a manner as to represent a positional relationship between a position regarding the installed object and the object lifted by the attachment with respect to the swing radius direction.

8. The work machine as claimed in claim 1, comprising:

a hardware processor configured to restrict a movement of the attachment.

9. The work machine as claimed in claim 8, wherein the hardware processor is configured to stop the movement of the attachment in response to determining that there is a possibility of contact between the object positioned in an area surrounding the work machine and the attachment or an object lifted by the attachment.

10. The work machine as claimed in claim 1, wherein the display is configured to display only a part of the attachment.

11. The work machine as claimed in claim 1, wherein a width of the object or an object lifted by the attachment is detected by the surrounding area monitor, and the guidance is provided based on the width.

12. The work machine as claimed in claim 1, wherein a position of the object is detected by the surrounding area monitor, and a position at a predetermined distance from a reference point of the object is displayed as the guidance.

13. The work machine as claimed in claim 1, wherein an upper surface of the object is detected by the surrounding area monitor, and the guidance is provided with respect to the detected upper surface.

14. The work machine as claimed in claim 1, wherein the object positioned in an area surrounding the work machine is an installed object installed by the work machine.

15. The work machine as claimed in claim 1, wherein the object positioned in an area surrounding the work machine is an installed object installed by the work machine, and the display is configured to display the guidance representing a positional relationship between a position regarding the installed object and an object lifted by the attachment.

16. The work machine as claimed in claim 1, wherein the guidance relates to a distance in a swing radius direction in front of the upper swing structure, and the display is configured to display the guidance as an image related to an area in front of the upper swing structure.

17. The work machine as claimed in claim 1, wherein the graphic indicates, by changing a display mode according to operation of the attachment, the position of the attachment in the swing radius direction of the attachment relative to the first object, or the position of the second object that is lifted by the attachment in the swing radius direction of the second object relative to the first object.

18. The work machine as claimed in claim 1, wherein one of the plurality of the markers indicates a position of the attachment or the second object in the swing radius direction of the attachment closest to a position of the attachment or the second object in the swing radius direction of the attachment after a predetermined time has elapsed.

19. The work machine as claimed in claim 18, wherein one of the plurality of the markers that indicates the position of the attachment or the second object in the swing radius direction of the attachment or the second object is filled with a first color, and the one of the plurality of the markers that indicates the position of the attachment in the swing radius direction of the attachment or the second object closest to the position of the attachment in the swing radius direction of the attachment or the second object after the predetermined time has elapsed is filled with a second color.

20. An assist device configured to assist in work with a work machine, the work machine including a lower traveling structure, an upper swing structure swingably mounted on the lower traveling structure, an attachment attached to the upper swing structure, and a surrounding area monitor, the assist device comprising:

a display configured to display a first object detected by the surrounding area monitor and guidance with respect to the first object, said first object and the guidance being displayed separately from each other, and wherein the guidance includes a graphic indicating a position of the attachment in a swing radius direction of the attachment relative to the first object, or a position of a second object that is lifted by the attachment in a swing radius direction of the second object relative to the first object, wherein the guidance includes a plurality of markers arranged in the swing radius direction of the attachment and indicates, by highlighting a marker corresponding to a position of the attachment, the position of the attachment relative to the first object, or the position of a second object that is lifted by the attachment relative to the first object, said plurality of markers indicating a position in the swing radius direction of the attachment.

21. A system configured to manage a work machine, the work machine including a lower traveling structure, an upper swing structure swingably mounted on the lower traveling structure, an attachment attached to the upper swing structure, and a surrounding area monitor, the system comprising:

a display; and a hardware processor configured to display a first object detected by the surrounding area monitor and guidance with respect to the first object, said first object and the guidance being displayed separately from each other, and wherein the guidance includes a graphic indicating a position of the attachment in a swing radius direction of the attachment relative to the first object, or a position of a second object that is lifted by the attachment in a swing radius direction of the second object relative to the first object, wherein the guidance includes a plurality of markers arranged in the swing radius direction of the attachment and indicates, by highlighting a marker corresponding to a position of the attachment, the position of the attachment relative to the first object, or the position of a second object that is lifted by the attachment relative to the first object, said plurality of markers indicating a position in the swing radius direction of the attachment.

* * * * *